US006942952B2

(12) United States Patent
Uesugi et al.

(10) Patent No.: US 6,942,952 B2
(45) Date of Patent: Sep. 13, 2005

(54) ELECTROPHOTGRAPHIC PHOTOSENSITIVE MEMBER, PROCESS CARTRIDGE, AND ELECTROPHOTGRAPHIC APPARATUS

(75) Inventors: Hirotoshi Uesugi, Shizuoka (JP); Hideki Anayama, Shizuoka (JP); Itaru Yamazaki, Shizuoka (JP); Kazushige Nakamura, Kanagawa (JP); Akira Yoshida, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/739,346

(22) Filed: Dec. 19, 2003

(65) Prior Publication Data

US 2004/0142259 A1 Jul. 22, 2004

Related U.S. Application Data

(63) Continuation of application No. PCT/JP03/08091, filed on Jun. 26, 2003.

(30) Foreign Application Priority Data

Jun. 28, 2002 (JP) ..... 2002-190031
Nov. 26, 2002 (JP) ..... 2002-342521

(51) Int. Cl.[7] ..... G03G 5/14
(52) U.S. Cl. ..... 430/66; 399/159
(58) Field of Search ..... 430/66; 399/159

(56) References Cited

U.S. PATENT DOCUMENTS 5,905,008 A 5/1999 Yoshinaga et al. ..... 430/58
5,935,747 A 8/1999 Miyazaki et al. ..... 430/58
6,093,515 A 7/2000 Yoshida et al. ..... 430/96
6,203,954 B1 3/2001 Anayama ..... 430/67
6,395,441 B1 5/2002 Uesugi et al. ..... 430/66
6,589,700 B2 7/2003 Tsutsumi et al. ..... 430/66

FOREIGN PATENT DOCUMENTS

| | | |
|---|---|---|
| EP | 0811885 A2 | 12/1997 |
| EP | 0969329 A1 | 1/2000 |
| JP | 10/69117 | 3/1998 |
| JP | 11-38664 | 2/1999 |
| JP | 00-81715 | 3/2000 |
| JP | 2001/249481 | 9/2001 |
| JP | 2001/249552 | 9/2001 |
| JP | 2002/162767 | 6/2002 |

*Primary Examiner*—Mark A. Chapman
(74) *Attorney, Agent, or Firm*—Fitzpatrick, Cella, Harper & Scinto

(57) ABSTRACT

The present invention provides an electrophotographic photosensitive member capable of maintaining high transfer efficiency without causing large transfer current for a long-term use, obtaining an excellent image, and achieving those effects especially when being applied to a color electrophotographic apparatus. The invention also provides a process cartridge and an electrophotographic apparatus each having such a photosensitive member. The present invention includes an electrophotographic photosensitive member having a photosensitive layer on a support, a surface layer containing diorganopolysiloxane having specific repeating structure units α and β, and having a weight-average molecular weight of 1,000 to 1,000,000; in which a content of the diorganopolysiloxane in the surface layer is 0.01 to 20% by weight based on the entire weight of the surface layer (except in the case where the surface layer contains fluorine atom-containing resin particles).

16 Claims, 2 Drawing Sheets

ELECTROPHOTGRAPHIC PHOTOSENSITIVE MEMBER, PROCESS CARTRIDGE, AND ELECTROPHOTGRAPHIC APPARATUS

This application is a continuation of International Application No. PCT/JP03/08091 filed on Jun. 26, 2003, which claims the benefit of Japanese Patent Applications No. 2002-190031 filed on Jun. 28, 2002 and No. 2002-342521 filed on Nov. 26, 2002.

BACKGROUND OF THE INVENTION

1. Field of the Invention

The present invention relates to an electrophotographic photosensitive member, and a process cartridge and an electrophotographic apparatus having such an electrophotographic photosensitive member.

2. Related Background Art

Conventionally, various systems such as an electrophotographic system, a thermal transfer system and an ink jet printing system have been employed for an image forming apparatus. Of those, an image forming apparatus employing the electrophotographic system (electrophotographic apparatus) is superior to those employing the other systems because it achieves a high speed, high image quality and quiet printing.

Furthermore, not only a monochrome electrophotographic apparatus but also a multiple color electrophotographic apparatus (a color electrophotographic apparatus) have recently become popular.

The color electrophotographic apparatus employs various well known systems such as a multiple transfer system, an intermediate transfer system or an inline system. Specifically, the multiple transfer system includes successively performing an exposure and a development for each color on a single electrophotographic photosensitive member, and successively transferring a toner image for each color to a transfer medium (e.g., paper) which is held on a transfer medium holding member (e.g., transfer drum), so as to form a color image. The intermediate transfer system includes successively performing an exposure and a development for each color on a single electrophotographic photosensitive member; successively primarily transferring a toner image for each color to an intermediate transfer member (e.g., an intermediate transfer drum, an intermediate transfer belt) (a primary transfer); and secondarily transferring in batch the primarily transferred image to a transfer medium (a secondary transfer), so as to form a color image. The inline system includes forming a toner image for each color in image forming portions for each color respectively, in which the image forming portions for each color are arranged in series and respectively have an electrophotographic photosensitive member, exposure means and development means, and successively transferring the toner image for each color to a transfer medium which is conveyed successively to the respective color image forming portions by a transfer medium convey member (e.g., transfer medium conveyor belt), so as to form a color image.

According to such a color electrophotographic apparatus, a plurality of transferring operations from an electrophotographic photosensitive member to a transfer medium or from an electrophotographic photosensitive member to an intermediate transfer member are required. Therefore, in the second or subsequent transferring operation, there exists toner for the color previously transferred on a portion to be printed between the electrophotographic photosensitive member and the transfer medium or between the electrophotographic photosensitive member and the intermediate transfer member. As a result, there arises a difference in transfer current between a portion where the toner exists and a portion where the toner does not exist. The transfer current difference causes a potential difference on the electrophotographic photosensitive member. The larger the transfer current, the more remarkable the tranfer current difference, which causes a faulty image such as a ghost image.

Furthermore, according to a color electrophotographic apparatus, the transfer current in many cases is set to be larger and larger as a new color image is overlapped on the previously transferred color image in order to avoid a so-called retransfer, i.e., a phenomenon in which the toner for the color previously transferred is carried back to the electrophotographic photosensitive member when the subsequent color image is transferred. Therefore, a faulty image due to the potential difference on the electrophotographic photosensitive member would be caused more easily as the more subsequent color image is transferred.

The large transfer current applies a high potential transfer bias to the electrophotographic photosensitive member, the intermediate transfer member or the transfer medium convey member. As a result, pin-hole leakage would be caused; durability of the electrophotographic photosensitive member would be deteriorated; and a material itself, which constitutes the electrophotographic photosensitive member, would be broken.

It is demanded for the whole electrophotographic apparatus to achieve sufficiently high transfer efficiency without causing large transfer current. Especially, higher transfer efficiency and smaller transfer current are eagerly required for a color electrophotographic apparatus as described above.

As means for improving transfer efficiency, techniques for improving a releasing property on the surface of an electrophotographic photosensitive member are known. Such techniques include incorporating silicone resin in the surface layer of the electrophotographic photosensitive member, or dispersing fluorine atom-containing resin particles (fluororesin powders) therein.

However, in the case of incorporating silicone resin in the surface layer of the electrophotographic photosensitive member, a sufficient releasing property necessary for transferring can not be obtained, while water repellency on the surface of the electrophotographic photosensitive member is somewhat improved. Furthermore, since silicone resin easily migrates to the surface of the layer, effect by the silicone resin is obtained only at the initial stage of use. More specifically, as the surface of the electrophotographic photosensitive member is worn out by a long-term use, the effective component is lost. As a result, the effect can not be maintained for a long period of time.

Compared to a technique using silicone resin, a technique for dispersing fluorine atom-containing resin particles in the surface layer of the electrophotographic photosensitive member is expected to provide an improved releasing property on the surface of the electrophotographic photosensitive member. Examples of the fluorine atom-containing resin particles include: tetrafluoroethylene resin; trifluorochloroethylene resin; tetrafluoroethylene hexafluoroethylenepropylene resin; vinyl fluoride resin; vinylidene fluoride resin; polydichlorodifluoroethylene resin; and a copolymer thereof (disclosed in Japanese Patent Application Nos. 2000-081715 and 2001-249481). Furthermore, Japanese Patent Application Nos. 2000-081715 and 2001-249481 disclose that dispersibility of the fluorine atom-containing resin particles in the surface layer of the electrophotographic photosensitive member is improved by incorporating diorganopolysiloxane having a specific chemical structure therein.

However, since the fluorine atom-containing resin particles in the surface layer of the electrophotographic photosensitive member scatter exposure light, a sharp electrostatic latent image is hardly obtained, which may cause some restriction on image quality.

It is demanded for the whole electrophotographic apparatus to maintain a satisfactory releasing property on the surface of the electrophotographic photosensitive member for a long-term use and to obtain a sharp electrostatic latent image. Especially, obtaining more satisfactory releasing property and a sharper electrostatic latent image is eagerly required for a color electrophotographic apparatus as described above in which a plurality of colors of toner images are formed and the images are overlapped so as to form a color image.

SUMMARY OF THE INVENTION

It is an object of the present invention to provide an electrophotographic photosensitive member capable of maintaining high transfer efficiency for a long-term use without causing large transfer current, obtaining an excellent image, and to provide an electrophotographic photosensitive member capable of maintaining high transfer efficiency for a long-term use without causing large transfer current, and obtaining an excellent image especially when being applied to the above-mentioned color electrophotographic apparatus. It is also an object of the present invention to provide a process cartridge and an electrophotographic apparatus each having such an electrophotographic photosensitive member.

The present invention relates to an electrophotographic photosensitive member including a photosensitive layer on a support, a surface layer containing diorganopolysiloxane having a repeating structure unit α represented by Formula (11) and a repeating structure unit β represented by Formula (12), and having a weight-average molecular weight of 1,000 to 1,000,000, in which the content of the diorganopolysiloxane in the surface layer is 0.01 to 20% by weight based on the entire weight of the surface layer (except in the case where the surface layer contains fluorine atom-containing resin particles):

(11)

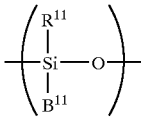

(12)

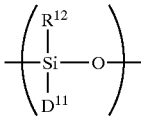

in Formulae (11) and (12), $R^{11}$ and $R^{12}$ are independently a substituted or unsubstituted monovalent hydrocarbon group, $B^{11}$ is a monovalent organic group having a perfluoroalkyl group, and $D^{11}$ is a monovalent group selected from the group consisting of: a monovalent organic group having a substituted or unsubstituted polystyrene chain with a polymerization degree of 3 or more; a monovalent organic group having a substituted or unsubstituted alkyleneoxy group; a monovalent organic group having a substituted or unsubstituted siloxane chain; and a monovalent organic group having carbon atoms of 12 or more.

Further, the present invention relates to a process cartridge detachably mountable to a main body of an electrophotographic apparatus, the process cartridge including and integrally supporting the above electrophotographic photosensitive member and at least one selected from the group consisting of: charging means for charging the surface of the electrophotographic photosensitive member; developing means for developing an electrostatic latent image formed on the surface of the electrophotographic photosensitive member by use of toner, so as to form a toner image; transfer means for transferring the toner image formed on the surface of the electrophotographic photosensitive member by the developing means to a transfer medium or an intermediate transfer member; and cleaning means for cleaning the toner remaining on the surface of the electrophotographic photosensitive member after the transferring process by the transfer means.

Further, the present invention relates to an electrophotographic apparatus, including: the electrophotographic photosensitive member; charging means for charging the surface of the electrophotographic photosensitive member; exposure means for exposing the surface of the electrophotographic photosensitive member charged by the charging means to exposure light, so as to form an electrostatic latent image; developing means for developing the electrostatic latent image, which is formed on the surface of the electrophotographic photosensitive member by the exposure means, by use of toner so as to form a toner image; and transfer means for transferring the toner image formed on the surface of the electrophotographic photosensitive member by the developing means to one of the transfer medium and an intermediate transfer member.

Further, the present invention relates to an electrophotographic apparatus, including: the electrophotographic photosensitive member; charging means for charging the surface of the electrophotographic photosensitive member; exposure means for exposing the surface of the electrophotographic photosensitive member charged by the charging means the exposure light, so as to form an electrostatic latent image; developing means for developing the electrostatic latent image, which is formed on the surface of the electrophotographic photosensitive member by the exposure means, by use of toner so as to form a toner image; transfer medium holding member for holding a transfer medium; and transfer means for transferring the toner image formed on the surface of the electrophotographic photosensitive member by the developing means to the transfer medium held on the transfer medium holding member.

Further, the present invention relates to an electrophotographic apparatus, including: the electrophotographic photosensitive member; charging means for charging the surface of the electrophotographic photosensitive member; exposure means for exposing the surface of the electrophotographic photosensitive member charged by the charging means to exposure light, so as to form an electrostatic latent image; developing means for developing the electrostatic latent image, which is formed on the surface of the electrophotographic photosensitive member by the exposure means, by use of toner so as to form a toner image; an intermediate transfer member for holding the toner image to be secondarily transferred to a transfer medium, the toner image having been formed on the surface of the electrophotographic photosensitive member by the developing means and primarily transferred from the surface of the electrophotographic photosensitive member; primary transfer means for primarily transferring the toner image formed on the surface of the electrophotographic photosensitive member by the developing means to the surface of the intermediate transfer member; and secondary transfer means for secondarily transferring the toner image held on the surface of the intermediate transfer member to the transfer medium.

Further, the present invention relates to an electrophotographic apparatus including a transfer medium convey member for holding and carrying a transfer medium to a transfer position, and a plurality of image forming portions; each of the image forming portions including at least: the above-mentioned electrophotographic photosensitive member; charging means for charging the surface of the electrophotographic photosensitive member; exposure means for exposing the surface of the electrophotographic photosensitive member charged by the charging means to exposure light, so as to form an electrostatic latent image; developing means for developing the electrostatic latent image, which is formed on the surface of the electrophotographic photosensitive member by the exposure means, by use of toner so as to form a toner image; and transfer means for transferring the toner image formed of the electrophotographic photosensitive member by the developing means to the transfer medium conveyed by the transfer medium convey member.

DESCRIPTION OF THE PREFERRED EMBODIMENTS

Figure 1:
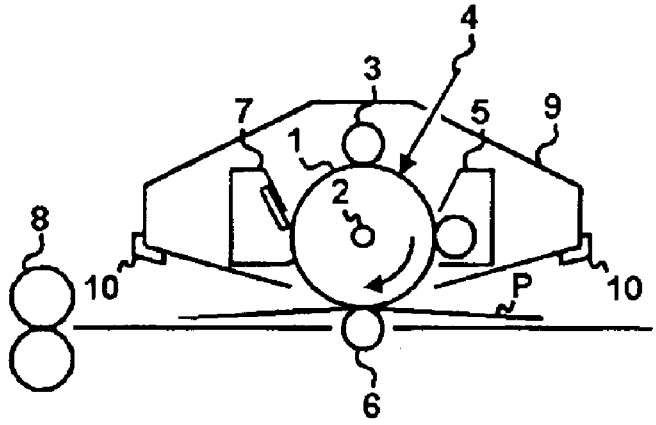
FIG. 1 is a schematic view illustrating an example of an electrophotographic apparatus provided with a process cartridge having an electrophotographic photosensitive member according to the present invention.

As described above, while it is expected that a releasing property of the surface of the electrophotographic photosensitive member is improved by incorporating fluorine atom-containing resin particles therein, the fluorine atom-containing resin particles may scatter exposure light. As a result, a sharp electrostatic latent image is hardly obtained. In view of that, a surface layer of an electrophotographic photosensitive member according to the present invention does not contain any fluorine atom-containing resin particles.

According to an embodiment of the present invention, the surface layer of the electrophotographic photosensitive member contains diorganopolysiloxane in place of the fluorine atom-containing resin particles. The diorganopolysiloxane has a repeating structure unit a represented by Formula (11) and a repeating structure unit β represented by Formula (12), and has a weight-average molecular weight of 1,000 to 1,000,000. By using such diorganopolysiloxane, a releasing property of the surface of the electrophotographic photosensitive member can be improved without causing exposure light scattering and sufficiently high transfer efficiency can be obtained without causing large transfer current.

(11)

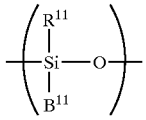

(12)

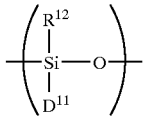

In Formulae (11) and (12), $R^{11}$ and $R^{12}$ are independently a substituted or unsubstituted monovalent hydrocarbon group, $B^{11}$ is a monovalent organic group having a perfluoroalkyl group, and $D^{11}$ is a monovalent group selected from the group consisting of: a monovalent organic group having a substituted or unsubstituted polystyrene chain with a polymerization degree of 3 or more; a monovalent organic group having a substituted or unsubstituted alkyleneoxy group; a monovalent organic group having a substituted or unsubstituted siloxane chain; and a monovalent organic group having carbon atoms of 12 or more.

Further, the diorganopolysiloxane may further have a repeating structure unit γ represented by Formula (13):

(13)

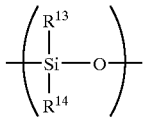

in Formula (13), $R^{13}$ and $R^{14}$ are independently a substituted or unsubstituted monovalent hydrocarbon group.

Furthermore, examples of an end group of the above-mentioned diorganopolysiloxane include an end group I having a structure represented by Formula (14) and an end group II having a structure represented by Formula (15).

$E^{11}$— (14)

(15)

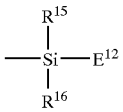

In Formulae (14) and (15), $R^{15}$ and $R^{16}$ are independently a substituted or unsubstituted monovalent hydrocarbon group, and $E^{11}$ and $E^{12}$ are independently a monovalent group selected from the group consisting of: a substituted or unsubstituted monovalent hydrocarbon group; a monovalent organic group having a perfluoroalkyl group; a monovalent organic group having a substituted or unsubstituted polystyrene chain with a polymerization degree of 3 or more; a monovalent organic group having a substituted or unsubstituted alkyleneoxy group; a monovalent organic group having a substituted or unsubstituted siloxane chain; and a monovalent organic group having carbon atoms of 12 or more; provided that $E^{11}$ in Formula (14) is bonded to a silicon atom Si in a main chain (—Si—O—) of the repeating structure unit of the diorganopolysiloxane and that a silicon atom Si in Formula (15) is bonded to an oxygen atom O in the main chain (—Si—O—) of the repeating structure unit of the diorganopolysiloxane.

In the present invention, the term "organic group" means a substituted or unsubstituted hydrocarbon group.

Further, examples of the hydrocarbon group include an alkyl group, an alkenyl group, an aryl group, and an arylalkenyl group.

Examples of the above monovalent hydrocarbon group of $R^{11}$ to $R^{16}$ include: a substituted or unsubstituted alkyl group; a substituted or unsubstituted alkenyl group; a substituted or unsubstituted aryl group; and a substituted or unsubstituted arylalkenyl group. The number of carbon atoms of each of those groups is preferably 1 to 30 and a methyl group or a phenyl group is more preferable.

The monovalent organic group having a perfluoroalkyl group represented by $B^{11}$ is preferably a monovalent group having a structure represented by Formula (2):

(2)

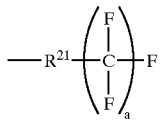

in Formula (2), $R^{21}$ is an alkylene group, or an alkyleneoxyalkylene group, and a is an integer of 3 or more.

Examples of the above alkylene group include an ethylene group, and a propylene group. Examples of the above alkyleneoxyalkylene group include an ethyleneoxyethylene group, an ethyleneoxypropylene group, and a propyleneoxypropylene group.

The monovalent organic group having a substituted or unsubstituted polystyrene chain with a polymerization degree of 3 or more represented by $D^{11}$ is preferably a monovalent group having a structure represented by Formula (3):

(3)

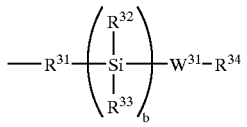

in Formula (3), $R^{31}$ is a substituted or unsubstituted divalent hydrocarbon group, $R^{32}$ and $R^{33}$ are independently a substituted or unsubstituted alkyl group or a substituted or unsubstituted aryl group, $W^{31}$ is a substituted or unsubstituted polystyrene chain with a polymerization degree of 3 or more, $R^{34}$ is a substituted or unsubstituted alkyl group or a substituted or unsubstituted aryl group, and b is 0 or 1.

Examples of the above divalent hydrocarbon group include alkylene groups such as a methylene group, an ethylene group, and a propylene group and the number of carbon atoms is preferably 1 to 10. Examples of the above alkyl group include a methyl group, an ethyl group, a propyl group, and a butyl group. The above aryl group is preferably unsubstituted, and hence a phenyl group, and the like can be given.

The monovalent organic group having a substituted or unsubstituted alkyleneoxy group represented by $D^{11}$ is preferably a monovalent group having a structure represented by Formula (4):

(4)

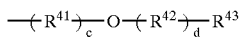

In Formula (4), $R^{41}$ and $R^{42}$ are independently a substituted or unsubstituted divalent hydrocarbon group, $R^{43}$ is a hydrogen atom or a substituted or unsubstituted monovalent hydrocarbon group, c is 0 or 1, and d is an integer of 1 or more and 300 or less.

Examples of the above divalent hydrocarbon group include: alkylene groups such as a methylene group, an ethylene group, and a propylene group; and arylene groups such as a phenylene group. Examples of the above monovalent hydrocarbon group include: alkyl groups such as a methyl group, an ethyl group, and a propyl group; and aryl groups such as a phenyl group. The above d is preferably 5 or more.

In Formula (12), the monovalent organic group having a substituted or unsubstituted siloxane chain represented by $D^{11}$ is preferably a monovalent group having a structure represented by Formula (5):

(5)

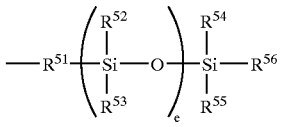

in Formula (5), $R^{51}$ is an alkylene group, an alkyleneoxy group or an oxygen atom, $R^{52}$ to $R^{56}$ are independently a substituted or unsubstituted alkyl group or a substituted or unsubstituted aryl group, and e is an integer of 3 or more.

Examples of the above alkylene group include an ethylene group, and a propylene group. Examples of the alkyleneoxy group include an ethyleneoxy group, and a propyleneoxy group. Examples of the above alkyl group include a methyl group, and an ethyl group. Examples of the aryl group include a phenyl group. The above e is preferably 5 or more.

Examples of the monovalent organic group having carbon atoms of 12 or more represented by $D^{11}$ include alkyl groups such as a n-dodecyl group, a n-tetradodecyl group, a n-hexadecyl group and a n-octadecyl group. The number of carbon atoms is preferably 100 or less.

Examples of a substituent with which each of the above-mentioned groups may be substituted include: halogen atoms such as a fluorine atom, a chlorine atom and an iodine atom; alkyl groups such as a methyl group, an ethyl group and a propyl group; and aryl groups such as a phenyl group.

The (average) number of the repeating structure units α represented by Formula (11) in the diorganopolysiloxane is preferably 1 to 1,000 and more preferably 10 to 200.

The (average) number of the repeating structure units β represented by Formula (12) in the diorganopolysiloxane is preferably 1 to 1,000 and more preferably 5 to 100.

The (average) number of the repeating structure units γ represented by Formula (13) in the diorganopolysiloxane is preferably 0 to 1,000 and more preferably 10 to 200.

Preferably, the diorganopolysiloxane is composed of the repeating structure unit a represented by Formula (11) and the repeating structure unit α represented by Formula (12) only, or of the repeating structure unit α represented by Formula (11), the repeating structure unit β represented by Formula (12) and the repeating structure unit γ represented by Formula (13) only.

The (average) sum of the numbers of the repeating structure units α represented by Formula (11), the repeating structure units β represented by Formula (12), and the repeating structure units γ represented by Formula (13) in the diorganopolysiloxane is preferably 2 to 2,000, more preferably 5 to 1,000, and furthermore preferably 20 to 500.

In the case where two or more of the repeating structure units α represented by Formula (11) are contained, respective $R^{11}$'s may be the same group or two or more of different groups and respective $B^{11}$'s may be the same group or two or more of different groups.

In the case where two or more of the repeating structure units β represented by Formula (12) are contained, respective $R^{12}$'s may be the same group or two or more of different groups and respective $D^{11}$'s may be the same group or two or more of different groups. As described above, $D^{11}$ is any one of a monovalent organic group having a substituted or unsubstituted polystyrene chain with a polymerization degree of 3 or more, a monovalent organic group having a substituted or unsubstituted alkyleneoxy group, a monovalent organic group having a substituted or unsubstituted siloxane chain, and a monovalent organic group having carbon atoms of 12 or more. In the case where a plurality of $D^{11}$'s are contained, at least one of $D^{11}$ is preferably a monovalent organic group having a substituted or unsubstituted siloxane chain.

In the case where two or more of the repeating structure units γ represented by Formula (13) are contained, respective $R^{13}$'s may be the same group or two or more of different groups and respective $R^{14}$'s may be the same group or two or more of different groups.

The same may be applied to $R^{32}$ and $R^{33}$ in Formula (3), $R^{42}$ in Formula (4), and $R^{52}$ and $R^{53}$ in Formula (5).

Hereinafter, specific examples of diorganopolysiloxane employed in the present invention will be described. However, the present invention is not limited to such specific examples. Furthermore, any of the below-indicated diorganopolysiloxanes (1-1) to (1-23) has an end group I having a structure represented by Formula (14) ($E^{11}$: a methyl group) and an end group II having a structure represented by Formula (15) ($E^{12}$, $R^{15}$ and $R^{16}$: a methyl group).

| | Repeating structure unit | Chemical Structure | Average (number) |
|---|---|---|---|
| (1-1) | α | 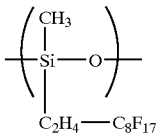 | 30 |
| | β | 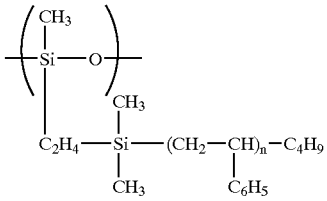 | 30 (n: Average 25) |
| | γ | 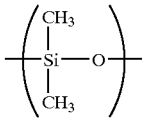 | 31 |
| (1-2) | α | 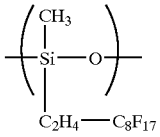 | 30 |
| | β | 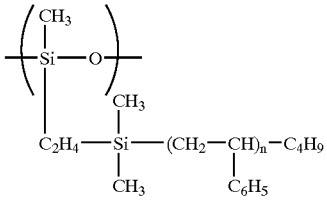 | 15 (n: Average 25) |
| | γ | 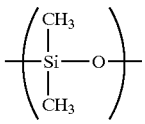 | 46 |

-continued
| | Repeating structure unit | Chemical Structure | Average (number) |
|---|---|---|---|
| (1-3) | α | 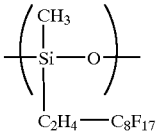 | 30 |
| | β | 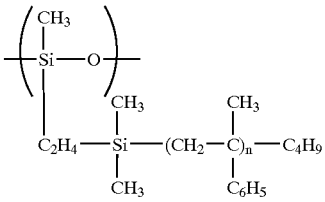 | 15 (n: Average 25) |
| | γ | 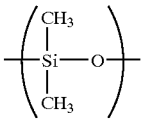 | 46 |
| (1-4) | α | 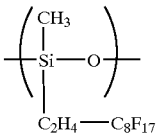 | 30 |
| | β | 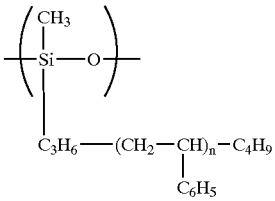 | 30 (n: Average 25) |
| | γ | 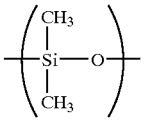 | 31 |
| (1-5) | α | 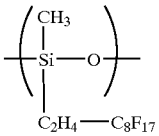 | 30 |
| | β | 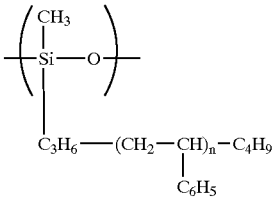 | 15 (n: Average 25) |
| | γ | 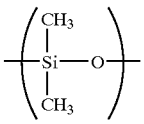 | 46 |

-continued
| | Repeating structure unit | Chemical Structure | Average (number) |
|---|---|---|---|
| (1-6) | α | 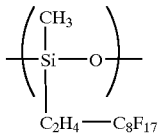 | 30 |
| | β | 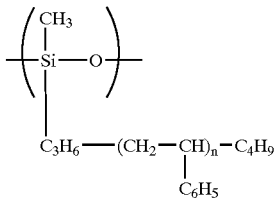 | 15 (n: Average 25) |
| | γ | 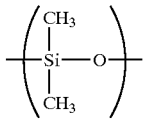 | 16 |
| | | 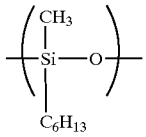 | 15 |
| (1-7) | α | 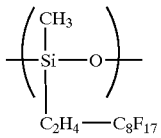 | 60 |
| | β | 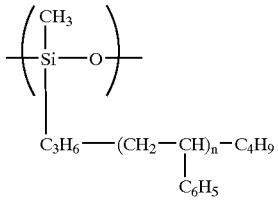 | 30 (n: Average 25) |
| | γ | 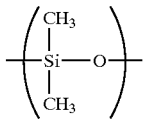 | 91 |
| (1-8) | α | 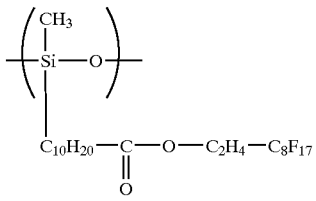 | 30 |

-continued
| | Repeating structure unit | Chemical Structure | Average (number) |
|---|---|---|---|
| | β | 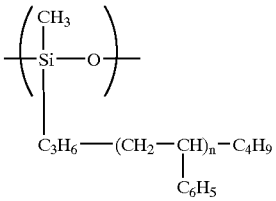 | 15 (n: Average 25) |
| | γ | 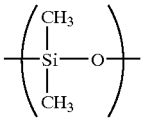 | 46 |
| (1-9) | α | 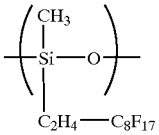 | 30 |
| | β | 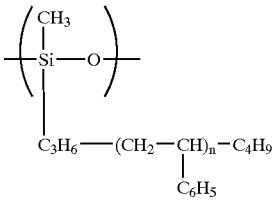 | 15 (n: Average 25) |
| | | 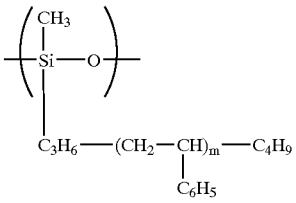 | 15 (m: Average 50) |
| | γ | 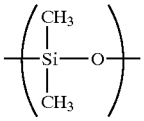 | 31 |
| (1-10) | α | 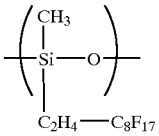 | 30 |
| | β | 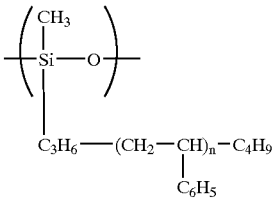 | 15 (n: Average 25) |

-continued

| | Repeating structure unit | Chemical Structure | Average (number) |
|---|---|---|---|
| | γ | $-\left(\begin{array}{c}CH_3\\ \vert\\ Si-O\\ \vert\\ CH_3\end{array}\right)-$ | 31 |
| | | $-\left(\begin{array}{c}CH_3\\ \vert\\ Si-O\\ \vert\\ C_6H_5\end{array}\right)-$ | 15 |
| (1-11) | α | $-\left(\begin{array}{c}CH_3\\ \vert\\ Si-O\\ \vert\\ C_2H_4-C_8F_{17}\end{array}\right)-$ | 30 |
| | β | $-\left(\begin{array}{c}CH_3\\ \vert\\ Si-O\\ \vert\\ C_3H_6-(CH_2-\underset{\vert\\ C_6H_5}{CH})_n-C_4H_9\end{array}\right)-$ | 15 (n: Average 50) |
| | γ | $-\left(\begin{array}{c}CH_3\\ \vert\\ Si-O\\ \vert\\ CH_3\end{array}\right)-$ | 46 |
| (1-12) | α | $-\left(\begin{array}{c}CH_3\\ \vert\\ Si-O\\ \vert\\ C_2H_4-C_8F_{17}\end{array}\right)-$ | 10 |
| | β | $-\left(\begin{array}{c}CH_3\\ \vert\\ Si-O\\ \vert\\ C_3H_6-(CH_2-\underset{\vert\\ C_6H_5}{CH})_n-C_4H_9\end{array}\right)-$ | 10 (n: Average 50) |
| | γ | $-\left(\begin{array}{c}CH_3\\ \vert\\ Si-O\\ \vert\\ CH_3\end{array}\right)-$ | 11 |
| | | $-\left(\begin{array}{c}CH_3\\ \vert\\ Si-O\\ \vert\\ C_6H_{13}\end{array}\right)-$ | 10 |

-continued
| | Repeating structure unit | Chemical Structure | Average (number) |
|---|---|---|---|
| (1-13) | α | 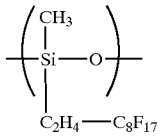 | 30 |
| | β | 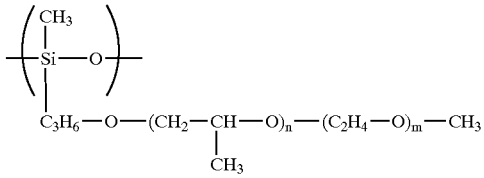 | 30 (n: Average 25, m: Average 25) |
| | γ | 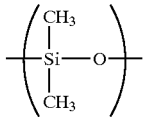 | 31 |
| (1-14) | α | 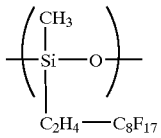 | 30 |
| | β | 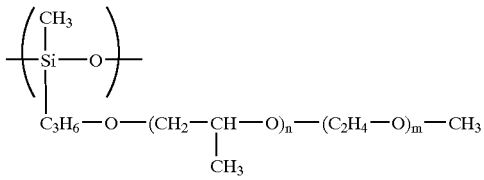 | 15 (n: Average 25, m: Average 25) |
| | | 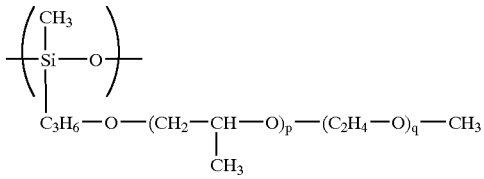 | 15 (p: Average 50, (q: Average 50) |
| | γ | 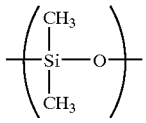 | 31 |
| (1-15) | α | 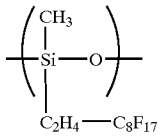 | 15 |
| | β | 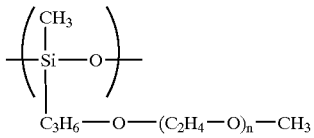 | 15 (n: Average 40) |

-continued
| | Repeating structure unit | Chemical Structure | Average (number) |
|---|---|---|---|
| | γ | 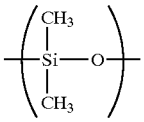 | 61 |
| (1-16) | α | 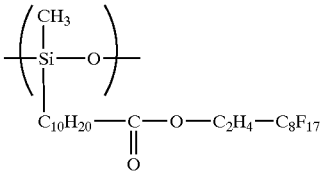 | 30 |
| | β | 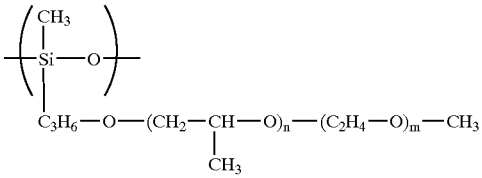 | 30 (n: Average 25, m: Average 25) |
| | γ | 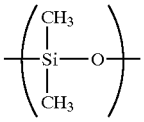 | 31 |
| (1-17) | α | 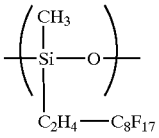 | 30 |
| | β | 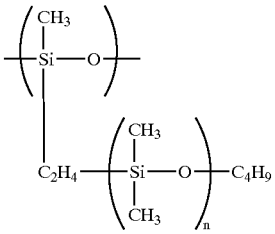 | 30 (n: Average 50) |
| | γ | 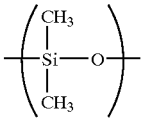 | 31 |
| (1-18) | α | 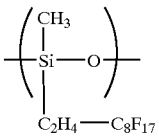 | 25 |

-continued
| | Repeating structure unit | Chemical Structure | Average (number) |
|---|---|---|---|
| | β | 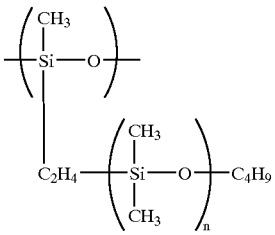 | 10 (n: Average 100) |
| | γ | 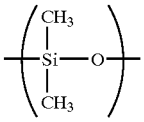 | 51 |
| (1-19) | α | 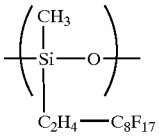 | 30 |
| | β | 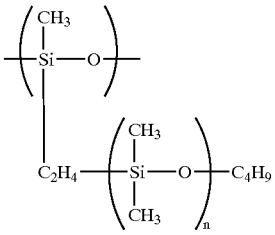 | 25 (n: Average 25) |
| | | 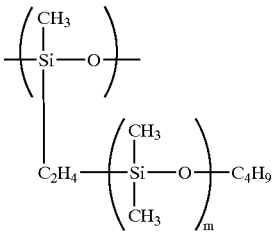 | 25 (n: Average 50) |
| | γ | 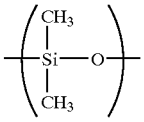 | 51 |
| (1-20) | α | 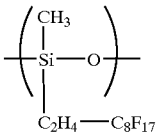 | 50 |

-continued
| | Repeating structure unit | Chemical Structure | Average (number) |
|---|---|---|---|
| | β | 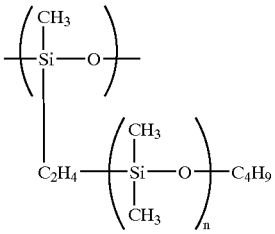 | 25 (n: Average 50) |
| | γ | 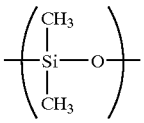 | 51 |
| | | 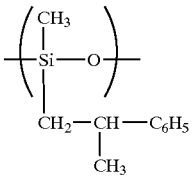 | 25 |
| (1-21) | α | 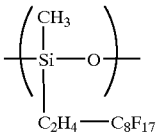 | 45 |
| | β | 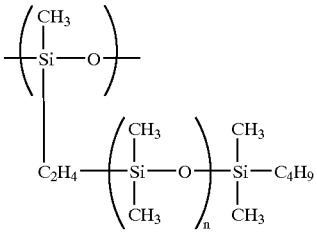 | 10 (n: Average 130) |
| | γ | 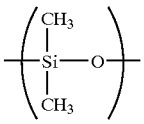 | 51 |
| (1-22) | α | 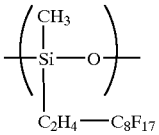 | 25 |
| | β | 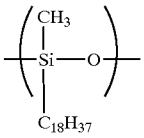 | 25 |
| | γ | 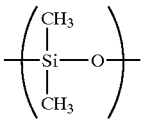 | 26 |

-continued

| | Repeating structure unit | Chemical Structure | Average (number) |
|---|---|---|---|
| (1-23) | α | 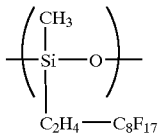 | 25 |
| | β | 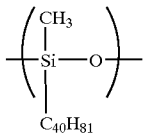 | 25 |
| | γ | 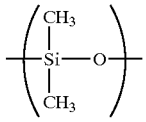 | 26 |

Of those, diorganopolysiloxanes (1-1), (1-4), (1-5), (1-7), (1-10), (1-14), (1-15) and (1-22) are preferred and diorganopolysiloxanes (1-1), (1-5), (1-10) and (1-22) are especially preferred.

Furthermore, the weight-average molecular weight of diorganopolysiloxane employed in the present invention is 1,000 to 1,000,000, preferably 10,000 to 200,000, more preferably 10,000 to 100,000 and most preferably 20,000 to 40,000.

Furthermore, the content of fluorine atoms in diorganopolysiloxane employed in the present invention is preferably 1 to 90% by weight and especially preferably 5 to 60% by weight based on the entire weight of the diorganopolysiloxane. If the content of fluorine atoms is less than 1% by weight, the releasing property of a surface layer in an electrophotographic photosensitive member may be insufficient. If the content of fluorine atoms exceeds 90% by weight, compatibility with a binder resin in the surface layer of the electrophotographic photosensitive member may be deteriorated or an anchoring effect may be insufficient. As a result, since migration of diorganopolysiloxane to the surface tends to be caused, satisfactory effect cannot be obtained if the surface of the electrophotographic photosensitive member is worn out by a long-term use.

Generally, silicone oil and a siloxane compound tend to migrate to the surface in a layer. Therefore, if the surface of the electrophotographic photosensitive member is worn out due to a long-term use, much of such effective components would be lost so that satisfactory effect can not be obtained.

In contrast, since diorganopolysiloxane employed in the present invention (especially $D^{11}$ substituent in a side chain thereof) has an anchoring effect with a binder resin in the surface layer of the electrophotographic photosensitive member, migration to the surface in the layer would be suppressed.

Hereinafter, a configuration of an electrophotographic photosensitive member according to the present invention will be described.

An electrophotographic photosensitive member according to the present invention has a photosensitive layer on a support.

Any material having conductivity (conductive support) may be used for the support. Examples of the support include: a metal support made of for example aluminum or stainless steel; and a support having a conductive layer on a metal, paper or plastic. Examples of a shape of the support include a cylindrical shape and a belt shape.

The photosensitive layer may be of a single layer type containing a charge generation material and a charge transport material in the same layer or of a layered type (a function separation type) having a charge generation layer containing a charge generation material and a charge transport layer containing a charge transport material separately. The layered type is preferred from the viewpoint of electrophotographic characteristics. Furthermore, the layered type photosensitive layer may include a normal order type photosensitive layer having a support, a charge generation layer and a charge transport layer in this order or a reverse type photosensitive layer having a support, a charge transport layer and a charge generation layer in this order. The normal order type photosensitive layer is preferred from the viewpoint of electrophotographic characteristics.

In the case where laser light is used as exposure light, in order to prevent interference fringes due to scattering, and also in order to cover a flaw of the support, a conductive layer may be provided on the support. The conductive layer can be formed by dispersing conductive particles such as carbon black and metal particles in a binder resin. Thickness of the conductive layer is preferably 5 to 40 μm, more preferably 10 to 30 μm. Interference fringes may also be prevented by performing a surface treatment of the support such as a machine treatment, an anodizing treatment, a dry blasting treatment and a wet blasting treatment.

An intermediate layer having an adhesion function or a barrier function may be provided on the support or the conductive layer. The intermediate layer can be formed by dissolving a resin such as polyamide, polyvinyl alcohol, polyethylene oxide, ethyl cellulose, casein, polyurethane or polyetherurethane in an appropriate solvent, applying the obtained solution onto the support or the conductive layer and drying the solution. Thickness of the intermediate layer is preferably 0.05 to 5 μm, more preferably 0.3 to 1 μm. The intermediate layer is not necessarily required in the case of performing an anodizing treatment on the support surface or using a conductive film obtained by a sol-gel method.

In the case where the normal order type photosensitive layer is employed as a photosensitive layer, a charge generation layer is provided on the support, the conductive layer or the intermediate layer.

Examples of the charge generation material include pigments such as selenium/tellurium, pyrylium, thiapyrylium dye, phthalocyanine, anthoanthrone, dibenzpyrenequinone, trisazo, cyanine, azo (trisazo, disazo, monoazo), indigo, quinacridone, and asymmetric quinocyanine.

The charge generation layer can be formed by sufficiently dispersing a charge generation material in a binder resin in a 0.3–4 fold (by weight) amount of the charge generation material and a solvent by means of a homogenizer, an ultrasonic disperser, a ball mill, a vibrating ball mill, a sand mill, Attritor, a roll mill, a fluid impact type high-speed disperser or the like so as to prepare a dispersant, and coating and drying the resultant dispersant. The binder resin may be added after dispersing the charge generation material. Furthermore, the binder resin is not necessarily required if the charge generation material has a film-forming property. Thickness of the charge generation layer is preferably 5 $\mu$m or less, more preferably 0.1 to 2 $\mu$m.

In the case where the normal order type photosensitive layer is employed as a photosensitive layer, a charge transport layer is provided on the charge generation layer.

Examples of the charge transport material include a triarylamine compound, a hydrazone compound, a stilbene compound, a pyrazoline compound, an oxazole compound, a triarylmethane compound, and a thiazole compound.

The charge transport layer can be formed by dissolving a charge transport material and a binder resin in a solvent, and coating and drying the obtained application solution. In the case where the charge transport layer is a surface layer of the electrophotographic photosensitive member, the charge transport layer may be formed by dissolving the charge transport material, the binder resin and the above-mentioned diorganopolysiloxane in a solvent, and coating and drying the obtained application solution. The weight ratio of the charge transport material to the binder resin is preferably 5:1 to 1:5, more preferably 3:1 to 1:3. Thickness of the charge transport layer is preferably 5 to 50 $\mu$m and more preferably 10 to 30 $\mu$m.

Examples of the binder resin of the charge transport layer include thermoplastic resins and curable resins. Specifically, phenoxy resin, polyacrylamide resin, polyvinyl butyral resin, polyarylate resin, polysulfone resin, polyamide resin, acrylic resin, acrylonitrile resin, methacrylic resin, vinyl chloride resin, vinyl acetate resin, phenolic resin, epoxy resin, polyester resin, alkyd resin, polycarbonate resin, polyurethane resin, and copolymers containing two or more repeating structure units of those resins such as: styrene/butadiene copolymer; styrene/acrylonitrile copolymer; and styrene/maleic acid copolymer. Further, the binder resin can be selected from organic photoconductive polymers such as poly-N-vinylcarbazole, polyvinylanthracene, and polyvinlypyrene.

Of those, polycarbonate resin and polyarylate resin are preferred because they have excellent compatibility with diorganopolysiloxane employed in the present invention and therefore an excellent application solution can be prepared. Especially, polycarbonate resin used together with diorganopolysiloxane preferably has a weight-average molecular weight in the range of 20,000 to 300,000 and more preferably of 50,000 to 150,000. Also, the polyarylate resin used together with diorganopolysiloxane preferably has a weight-average molecular weight in the range of 20,000 to 300,000 and more preferably of 50,000 to 150,000.

Furthermore, the polycarbonate resin is preferably one having a repeating structure unit represented by Formula (6):

(6)

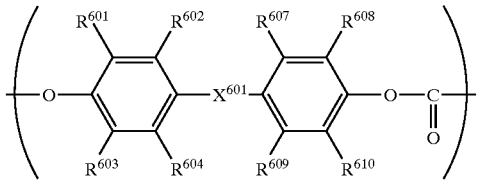

In Formula (6), $X^{601}$ is a single bond, a carbonyl group, an ether group, a thioether group or a —$CR^{605}R^{606}$— group (wherein $R^{605}$ and $R^{606}$ are independently a hydrogen atom, a substituted or unsubstituted alkyl group or a substituted or unsubstituted aryl group, or $R^{605}$ and $R^{606}$ are bonded together to form a substituted or unsubstituted cycloalkylidene group), and $R^{601}$ to $R^{604}$, and $R^{607}$ to $R^{610}$ are independently a hydrogen atom, a halogen atom, a substituted or unsubstituted alkyl group or a substituted or unsubstituted aryl group.

Of those, $X^{601}$ is preferably a single bond or a —$CR^{605}R^{606}$— group, and each of $R^{602}$, $R^{604}$, $R^{607}$ and $R^{609}$ is preferably a hydrogen atom.

Furthermore, the polyarylate resin is preferably one having a repeating structure unit represented by Formula (7):

(7)

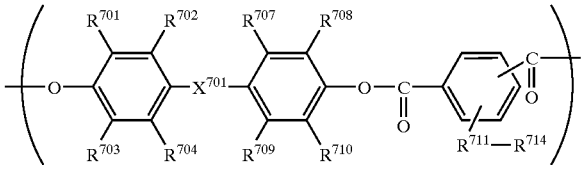

In Formula (7), $X^{701}$ is a single bond, a carbonyl group, an ether group, a thioether group or a —$CR^{705}R^{706}$— group (wherein $R^{705}$ and $R^{706}$ are independently a hydrogen atom, a substituted or unsubstituted alkyl group or a substituted or unsubstituted aryl group, or $R^{705}$ and $R^{706}$ are bonded together to form a substituted or unsubstituted cycloalkylidene group), and $R^{701}$ to $R^{704}$, and $R^{707}$ to $R^{714}$ are independently a hydrogen atom, a halogen atom, a substituted or unsubstituted alkyl group or a substituted or unsubstituted aryl group.

Of those, $X^{701}$ is preferably a single bond or a —$CR^{705}R^{706}$— group, and each of $R^{702}$, $R^{704}$, $R^{707}$ and $R^{709}$ is preferably a hydrogen atom.

Examples of the halogen atom in Formulae (6) and (7) include a fluorine atom, a chlorine atom, and an iodine atom. Examples of the alkyl group include a methyl group, an ethyl group, and a propyl group. Examples of the aryl group include a phenyl group, and a naphthyl group. Examples of the cycloalkylidene include a cyclohexylidene group.

Examples of the substituents that each of those groups may have include: halogen atoms such as a fluorine atom, a chlorine atom, and an iodine atom; alkyl groups such as a methyl group, an ethyl group, and a propyl group; and aryl groups such as a phenyl group.

Specific examples of a repeating structure unit represented by Formula (6) will be given below.

(6-1)
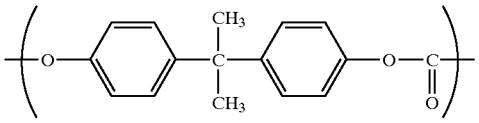
(6-2)
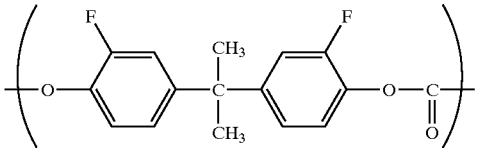
(6-3)
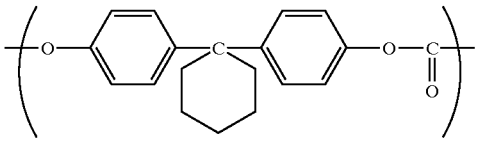
(6-4)
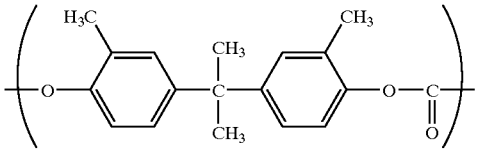
(6-5)
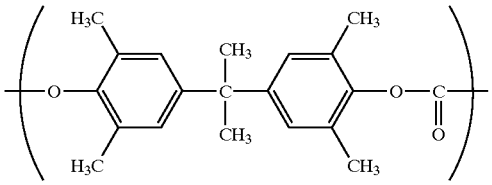
(6-6)
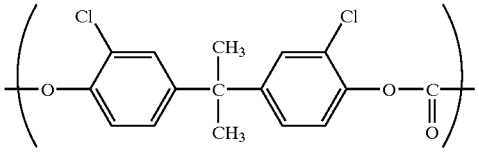
(6-7)
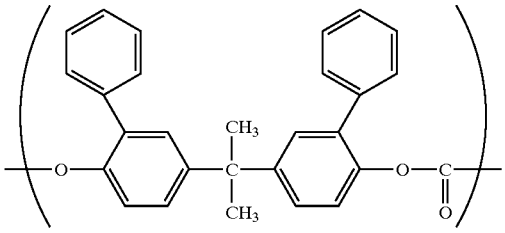
(6-8)
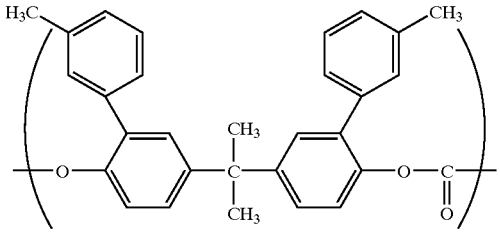
-continued
(6-9)
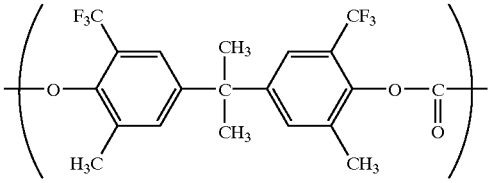
(6-10)
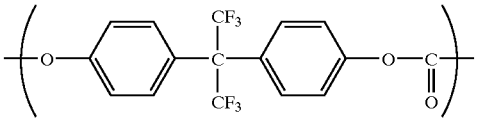
(6-11)
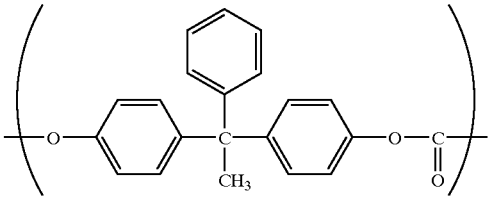
(6-12)
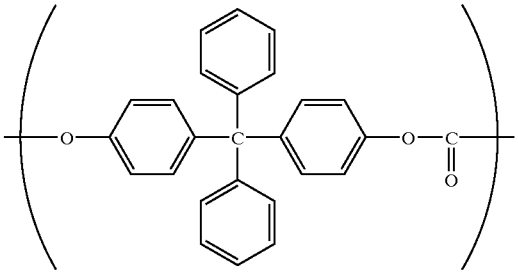
(6-13)
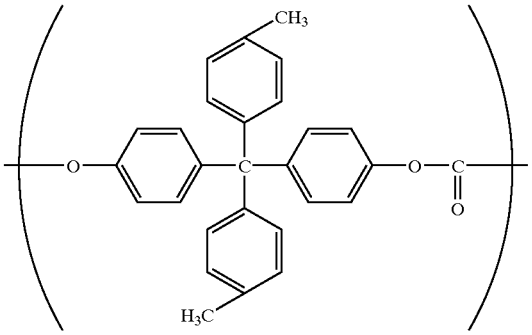
(6-14)
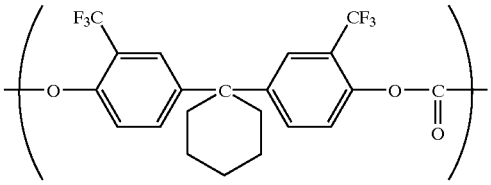

-continued
(6-15)
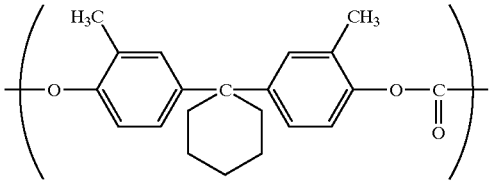
(6-16)
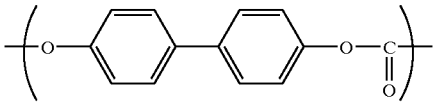
Of those, diorganopolysiloxanes (6-1), (6-3), (6-4), (6-10), and (6-16) are preferred and diorganopolysiloxanes (6-1), (6-3), and (6-16) are especially preferred.
Specific examples of a repeating structure unit represented by Formula (7) will be given below.
(7-1)
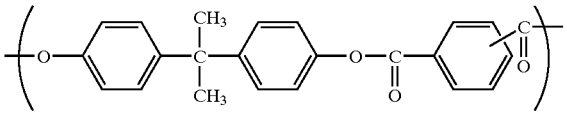
(7-2)
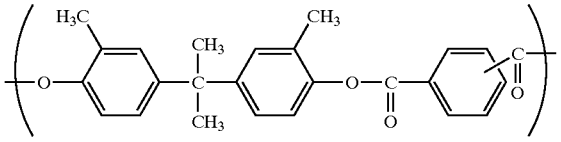
(7-3)
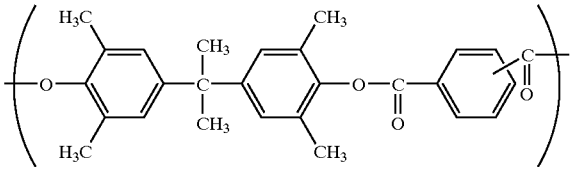
(7-4)
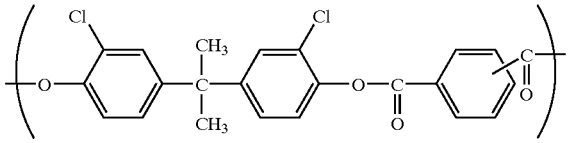
(7-5)
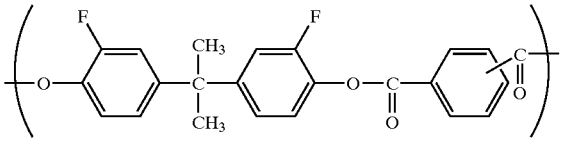
(7-6)
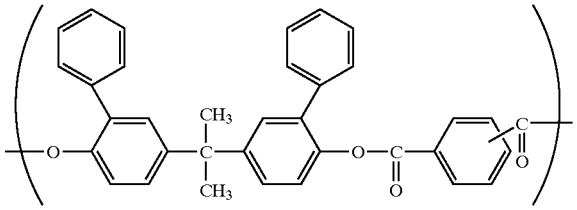
-continued
(7-7)
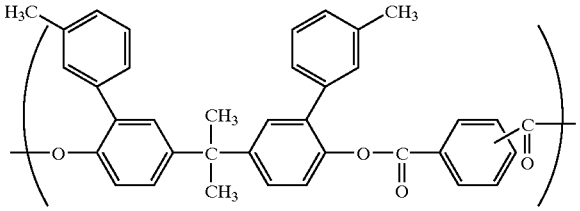
(7-8)
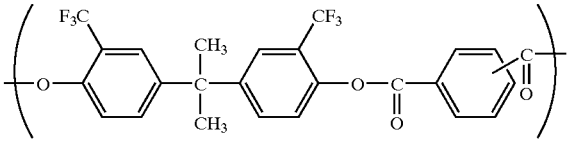
(7-9)
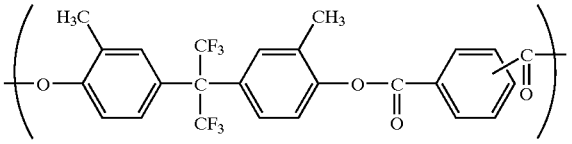
(7-10)
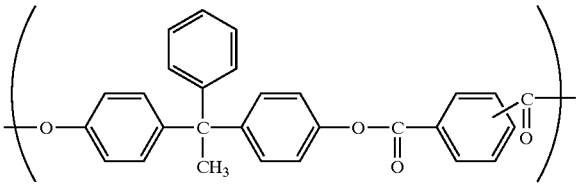
(7-11)
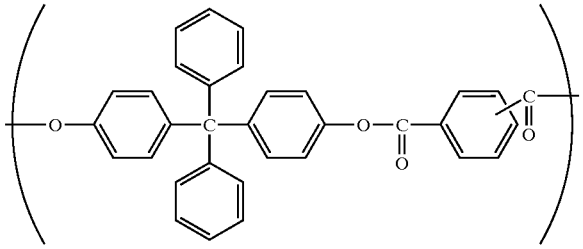
(7-12)
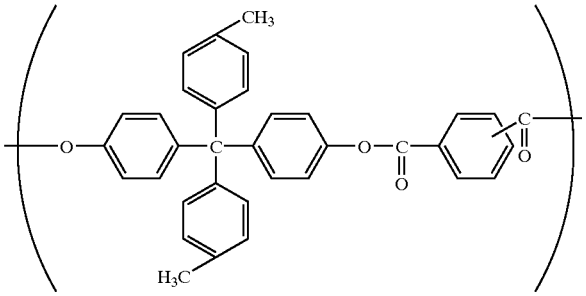
(7-13)
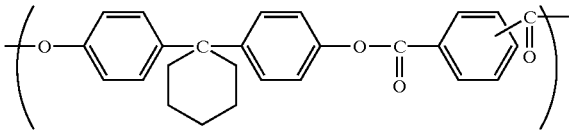

-continued (7-14)

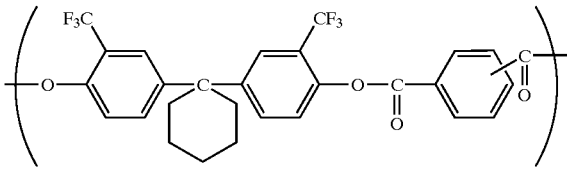

(7-15)

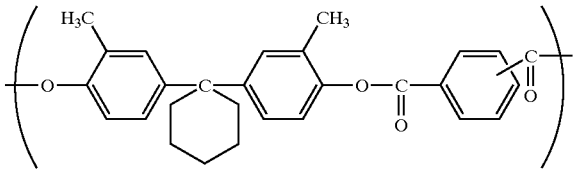

(7-16)

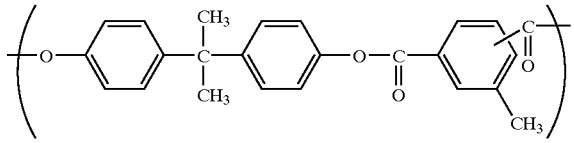

(7-17)

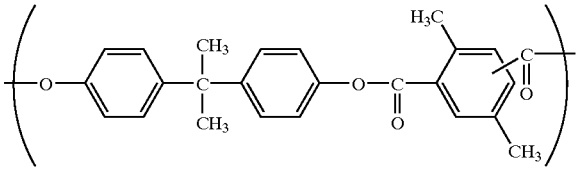

(7-18)

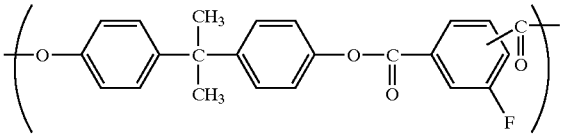

(7-19)

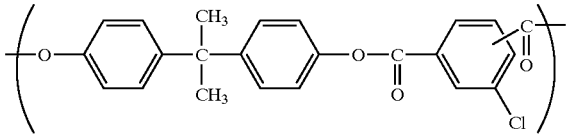

(7-20)

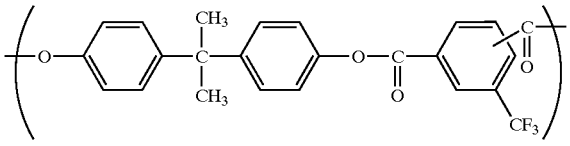

(7-21)

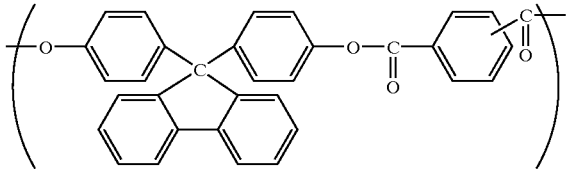

-continued (7-22)

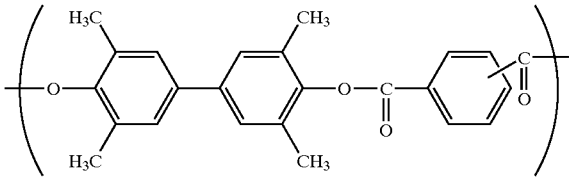

(7-23)

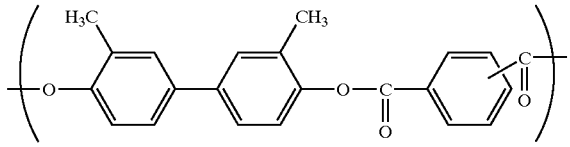

Of those, diorganopolysiloxanes (7-2), (7-3), (7-6), (7-13), (7-22), and (7-23) are preferred and diorganopolysiloxanes (7-3), (7-13), and (7-22) are especially preferred.

The content of the above-mentioned diorganopolysiloxane in the surface layer of the electrophotographic photosensitive member is preferably 0.01 to 20% by weight and more preferably 0.1 to 10.0% by weight based on the entire weight of the surface layer. In the case where the surface layer of the electrophotographic photosensitive member is a charge transport layer, the content of the above-mentioned diorganopolysiloxane in the charge transport layer is preferably 0.01 to 20% by weight and more preferably 0.1 to 10.0% by weight based on the entire weight of the charge transport layer, too. If the content is too small, an effect according to the present invention is hardly obtained. Too large content may cause a carrier trap and as a result, a potential variation may be caused.

Since a charge generation material and a charge transport material, both of which are organic photoconductive materials, are generally sensitive to an ultraviolet radiation, ozone, oil stain, a metal or the like, a protective layer may be provided on the photosensitive layer as a surface layer of the electrophotographic photosensitive member in order to protect the photosensitive layer.

The protective layer as a surface layer of the electrophotographic photosensitive member can be formed by dissolving the above-mentioned diorganopolysiloxane and a binder resin in an appropriate solvent, applying the obtained application solution onto the photosensitive layer and drying the solution. Examples of the binder resin include polyester resin, polycarbonate resin, acryl resin, methacryl resin, polyamide resin, polyimide resin, polyarylate resin, polyurethane resin, styrene-butadiene copolymer, styrene-acrylonitrile copolymer and styrene-acrylic acid copolymer. In the case where a resin obtained from a condensation type monomer or a radical polymerization type monomer having an unsaturated group is used as a binder resin in the protective layer, the protective layer may also be formed by curing the application solution on the photosensitive layer by irradiating it with heat or energy light such as an ultraviolet radiation after applying the application solution. Thickness of the protective layer is preferably 0.05 to 20 $\mu$m.

Since the protective layer can be made thinner than the charge transport layer, it is possible to increase the amount of the above-mentioned diorganopolysiloxane therein.

A surface layer of an electrophotographic photosensitive member according to the present invention may further contain conductive particles such as metal and conductive metal oxide, and/or a charge transport material, if necessary.

Examples of an application method for forming the above-mentioned respective layers include a dip coating method, a spray coating method, a spinner coating method, a blade coating method and a roll coating method.

FIG. 1 is a schematic view illustrating an example of an electrophotographic apparatus provided with a process cartridge having an electrophotographic photosensitive member according to the present invention.

In FIG. 1, reference numeral 1 denotes an electrophotographic photosensitive member according to the present invention having a drum shape. The electrophotographic photosensitive member 1 rotates around an axis 2 in the direction indicated by an arrow with a predetermined peripheral velocity.

The electrophotographic photosensitive member 1 to be rotatively driven is evenly charged on the peripheral surface to a predetermined positive or negative potential by charging means (primary charging means) 3, and then is irradiated with exposure light (image exposure light) 4 from exposure means (not shown) such as slit exposure means and laser beam scanning exposure means. In such a manner, an electrostatic latent image corresponding to a desired image is successively formed on the peripheral surface of the electrophotographic photosensitive member 1.

The electrostatic latent image formed on the peripheral surface of the electrophotographic photosensitive member 1 is developed by use of a toner in developing means 5 to be made into a toner image. Then, the toner image formed and held on the peripheral surface of the electrophotographic photosensitive member 1 is successively transferred to a transfer medium (e.g., paper) P by means of a transfer bias of transfer means (a transfer roller) 6. The transfer medium is transported from transfer medium feeding means (not shown) to a position (a contact position) between the electrophotographic photosensitive member 1 and the transfer means 6 in synchronism with the rotation of the electrophotographic photosensitive member 1.

The transfer medium P on which the toner image has been transferred is separated from the peripheral surface of the electrophotographic photosensitive member 1 and is transported to fixing means 8 so that the toner image is fixed on the transfer medium to obtain an image-formed product (e.g., a print, a copy). The image-formed product is thus printed out to the outside of the electrophotographic apparatus.

The peripheral surface of the electrophotographic photosensitive member 1 after the transfer of the toner image is cleaned by removing transfer residual toner therefrom by use of cleaning means (a cleaning blade) 7. Furthermore, the electrophotographic photosensitive member 1 is subjected to a charge elimination treatment by being irradiated with pre-exposure light (not shown) from pre-exposure means (not shown) and thereafter is repeatedly used for the next image formation. In the case where the charging means 3 is contact charging means such as a charging roller as shown in FIG. 1, the pre-exposure means is not necessarily required.

Among the above-mentioned constituting elements such as the electrophotographic photosensitive member 1, the charging means 3, the developing means 5, the transfer means 6 and the cleaning means 7, a plurality of elements can be arranged in a container to be integrally assembled into a process cartridge detachably mountable to a main body of the electrophotographic apparatus such as a copying machine and a laser beam printer. In the embodiment shown in FIG. 1, the electrophotographic photosensitive member 1, the charging means 3, the developing means 5 and the cleaning means 7 are integrally supported and made into a process cartridge 9, which is detachably mountable to a main body of the electrophotographic apparatus through guiding means 10 such as a rail mounted in the main body.

It is demanded for the whole gamut of electrophotographic apparatus to maintain a satisfactory releasing property on the surface of the electrophotographic photosensitive member for a long-term use so as to achieve sufficiently high transfer efficiency without causing large transfer current, and to obtain a sharp electrostatic latent image. Especially, achieving those effects is highly required for a color electrophotographic apparatus (employing, for example, a multiple transfer system, an intermediate transfer system or an inline system). In view of that, the electrophotographic photosensitive member according to the present invention is especially preferred as an electrophotographic photosensitive member for a color electrophotographic apparatus.

Hereinafter, as examples of a color electrophotographic apparatus, a color electrophotographic apparatus employing the intermediate transfer system and that employing the inline system will be described, respectively. Although a four-color (yellow, magenta, cyan and black) electrophotographic apparatus will be described in the below-indicated embodiments, the term "color" used in the present invention is not limited to the four colors and means multiple colors, more specifically two or more colors.

Figure 2:
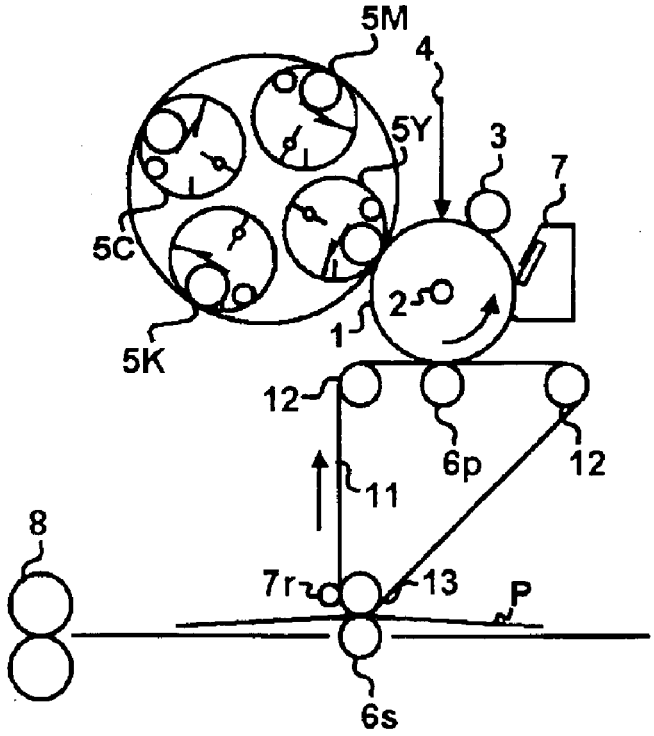
FIG. 2 is a schematic view illustrating an example of a color electrophotographic apparatus having an electrophotographic photosensitive member according to the present invention and employing an intermediate transfer system.

FIG. 2 is a schematic view illustrating an example of a color electrophotographic apparatus having an electrophotographic photosensitive member according to the present invention and employing the intermediate transfer system.

In FIG. 2, reference numeral 1 denotes an electrophotographic photosensitive member according to the present invention having a drum shape. The electrophotographic photosensitive member 1 rotates around an axis 2 in the direction indicated by an arrow with a predetermined peripheral velocity.

A peripheral surface of the electrophotographic photosensitive member 1 to be rotated is evenly charged at a predetermined positive or negative potential by charging means (primary charging means) 3, and then is irradiated with exposure light (image exposure light) 4 from exposure means (not shown) such as slit exposure means and laser beam scanning exposure means. The exposure light at that time corresponds to image information on a first color component image (e.g., yellow component image) of a desired color image. In such a manner, a first color component electrostatic latent image (a yellow component electrostatic latent image) corresponding to image information on a first color component image of a desired color image is successively formed on the peripheral surface of the electrophotographic photosensitive member 1.

An intermediate transfer member (an intermediate transfer belt) 11, which is fitted over and around a roller 12 and a secondary transfer opposed roller 13, rotates in the direction indicated by an arrow with a peripheral velocity substantially the same as the peripheral velocity of the electrophotographic photosensitive member 1 (specifically, 97 to 103% of the peripheral velocity of the electrophotographic photosensitive member 1).

The first color component electrostatic latent image formed on the peripheral surface of the electrophotographic photosensitive member 1 is developed by use of first color toner (yellow toner) of first color component developing means (yellow component developing means) 5Y to be made into a first color toner image (a yellow toner image).

Then, the first color toner image formed and held on the peripheral surface of the electrophotographic photosensitive member 1 is successively primarily transferred to a peripheral surface of the intermediate transfer member 11 by means of a primary transfer bias from primary transfer means 6*p*. The intermediate transfer member 11 is transported between the electrophotographic photosensitive member 1 and the primary transfer means (a primary transfer roller) 6*p*.

The peripheral surface of the electrophotographic photosensitive member 1 after the transfer of the first color toner image is cleaned by removing primary transfer residual toner therefrom by use of cleaning means 7. Then, the electrophotographic photosensitive member 1 is used for the image formation of next color.

A second color toner image (a magenta toner image), a third color toner image (a cyan toner image) and a fourth color toner image (a black toner image) are respectively formed on the peripheral surface of the electrophotographic photosensitive member 1 and are successively transferred to the peripheral surface of the intermediate transfer member 11 in the same manner as the first color toner image. As a result, a composite toner image corresponding to a desired color image is formed on the peripheral surface of the intermediate transfer member 11. During the primary transfer of the first color to the fourth color, secondary transfer means (a secondary transfer roller) 6*s* and charge providing means (a charge providing roller) 7*r* are positioned out of contact with the peripheral surface of the intermediate transfer member 11. Incidentally, reference characters 5M, 5C and 5K in FIG. 2 denote second color component developing means (magenta component developing means), third color component developing means (cyan component developing means) and fourth color component developing means (black component developing means), respectively.

The composite toner image formed on the peripheral surface of the intermediate transfer member 11 is secondarily transferred to a transfer medium (e.g., paper) P by a secondary transfer bias of secondary transfer means 6*s*. The transfer medium is transported from transfer medium feeding means (not shown) to a position (a contact position) between the intermediate transfer member 11 and the secondary transfer means 6*s* in synchronism with the rotation of the intermediate transfer member 11.

The transfer medium P on which the composite toner image has been transferred is separated from the peripheral surface of the intermediate transfer member 11 and is transported to fixing means 8 so that the composite toner image is fixed on the transfer medium to obtain a color-image-formed product (e.g., a print, a copy). The color-image-formed product is thus printed out to the outside of the electrophotographic apparatus.

Charge providing means 7*r* is arranged to be in contact with the peripheral surface of the intermediate transfer member 11 after the composite toner image has been transferred. The charge providing means 7*r* provides secondary transfer residual toner with charge opposite in polarity to that in the primary transfer process. The secondary transfer residual toner provided with charge opposite in polarity to that in the primary transfer process is electrostatically transferred to the peripheral surface of the electrophotographic photosensitive member 1 at the contact position between the electrophotographic photosensitive member 1 and the intermediate transfer member 11 and in the vicinity thereof. In such a manner, the peripheral surface of the intermediate transfer member 11 after the transfer of the composite toner image is cleaned by removing the transfer residual toner. The secondary transfer residual toner transferred to the peripheral surface of the electrophotographic photosensitive member 1 and the primary transfer residual toner thereon are removed by cleaning means 7. Since the transfer of the secondary transfer residual toner from the intermediate transfer member 11 to the electrophotographic photosensitive member 1 can be performed simultaneously with the primary transfer process, deterioration of throughput is not caused.

Furthermore, the peripheral surface of the electrophotographic photosensitive member 1 after the removal of the transfer residual toner by cleaning means 7 may be subjected to a charge elimination treatment by being irradiated with pre-exposure light from pre-exposure means. However, in the case where the charging means 3 is contact charging means such as a charging roller as shown in FIG. 2, the pre-exposure means is not necessarily required.

Figure 3:
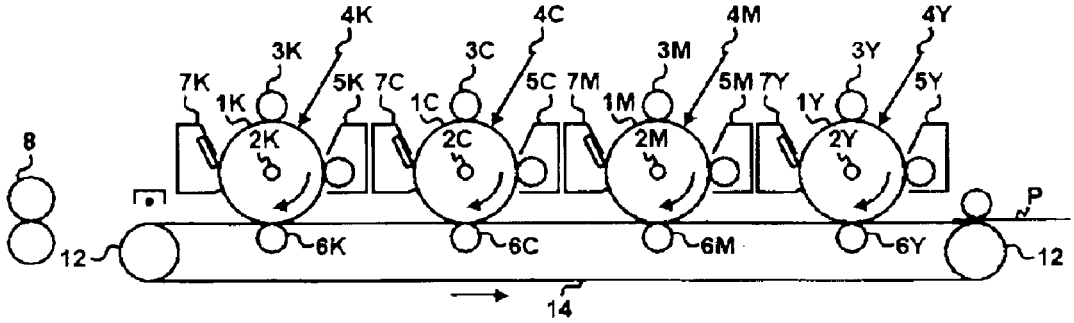
FIG. 3 is a schematic view illustrating an example of a color electrophotographic apparatus having an electrophotographic photosensitive member according to the present invention and employing an inline system.

FIG. 3 is a schematic view illustrating an example of a color electrophotographic apparatus having an electrophotographic photosensitive member according to the present invention and employing the inline system.

In FIG. 3, reference characters 1Y, 1M, 1C and 1K respectively denote an electrophotographic photosensitive member (a first color one to a fourth color one) according to the present invention having a drum shape. These electrophotographic photosensitive members are rotatively driven around axes 2Y, 2M, 2C and 2K, respectively, in the direction indicated by an arrow with a predetermined peripheral velocity.

A peripheral surface of the first color electrophotographic photosensitive member 1Y to be rotatively driven is evenly charged at a predetermined positive or negative potential by first color charging means (first color primary charging means) 3Y, and then is irradiated with exposure light (image exposure light) 4Y from exposure means (not shown) such as slit exposure means and laser beam scanning exposure means. The exposure light 4Y is exposure light corresponding to a first color component image (e.g., yellow component image) of a desired color image. In such a manner, a first color component electrostatic latent image (a yellow component electrostatic latent image) corresponding a first color component image of a desired color image is successively formed on the peripheral surface of the first color electrophotographic photosensitive member 1Y.

A transfer medium convey member (a transfer medium conveyor belt) 14, which is fitted over and around a pair of rollers 12, rotates in the direction indicated by an arrow with a peripheral velocity substantially the same as the peripheral velocity of the first color to fourth color electrophotographic photosensitive members 1Y, 1M, 1C and 1K (specifically, 97 to 103% of the peripheral velocity of the first color to fourth color electrophotographic photosensitive members 1Y, 1M, 1C and 1K). Furthermore, a transfer medium (e.g., paper) P which has been transported from transfer medium feeding means (not shown) is electrostatically held (attached) on the transfer medium convey member 14 and is successively fed to positions (contact positions) between the first color to fourth color electrophotographic photosensitive members 1Y, 1M, 1C and 1K and the transfer medium convey member 14.

The first color component electrostatic latent image formed on the peripheral surface of the first color electrophotographic photosensitive member 1Y is developed by use of a toner in first color component developing means 5Y to be made into a first color toner image (a yellow toner image). Then, the first color toner image formed and held on the peripheral surface of the first color electrophotographic photosensitive member 1Y is successively transferred to the transfer medium P held on the transfer medium transport member 14, which is transported between the first color electrophotographic photosensitive member 1Y and first color transfer means (a first color transfer roller) 6Y, by a transfer bias from the first color transfer means (a first color transfer roller) 6Y.

The peripheral surface of the first color electrophotographic photosensitive member 1Y after the first color toner image has been transferred is cleaned by removing transfer residual toner therefrom by first color cleaning means (a first color cleaning blade) 7Y. Then, the electrophotographic photosensitive member 1 is repeatedly used for the first color toner image formation.

Here, first color charging means 3Y, first color exposure means 4Y, first color developing means 5Y and first color transfer means 6Y are collectively referred to as a first color image forming portion.

A second color image forming portion having second color charging means 3M, second color exposure means 4M, second color developing means 5M and second color transfer means 6M; a third color image forming portion having third color charging means 3C, third color exposure means 4C, third color developing means 5C and third color transfer means 6C; and a fourth color image forming portion having fourth color charging means 3K, fourth color exposure means 4K, fourth color developing means 5K and fourth color transfer means 6K are respectively operated in the same manner as the first color image forming portion. Specifically, a second color toner image (a magenta toner image), a third color toner image (a cyan toner image) and a fourth color toner image (a black toner image) are successively transferred to the transfer medium P which is held on the transfer medium convey member 14 and onto which the first color toner image has been transferred. In such a manner, a composite toner image corresponding to a desired color image is formed on the transfer medium P held on the transfer medium convey member 14.

The transfer medium P on which the composite toner image has been formed is separated from the peripheral surface of the transfer medium convey member 14 and is transported to fixing means 8 so that the composite toner image is fixed on the transfer medium to obtain a color image-formed product (e.g., a print, a copy). The color image-formed product is printed out to the outside of the electrophotographic apparatus.

Furthermore, the peripheral surfaces of the first color to fourth color electrophotographic photosensitive members 1Y, 1M, 1C and 1K after the removal of the transfer residual toner by first color to fourth color cleaning means 7Y, 7M, 7C and 7K may be subjected to a charge elimination treatment by being exposed to pre-exposure light from pre-exposure means, respectively. However, in the case where the first color to fourth color charging means 3Y, 3M, 3C and 3K are contact charging means such as a charging roller as shown in FIG. 3, the pre-exposure means is not necessarily required.

Next, an intermediate transfer member will be described.

Examples of the intermediate transfer member include an endless intermediate transfer belt which is fitted over and around a roller (including a driving roller and a tension roller). Volume resistivity of the intermediate transfer belt is preferably $10^6$ to $10^{12}$ Ω·cm. If the volume resistivity of the intermediate transfer belt is too small, a difference in the resistance of the intermediate transfer belt between a portion which is subjected to the primary transfer and a portion which is not subjected to the primary transfer would be too large. As a result, since second or subsequent color toner can not be effectively transferred, a color image having desired tone can not be obtained. In contrast, if the volume resistivity of the intermediate transfer belt is too large, when second or subsequent color toner is primarily transferred, previously primarily transferred toner may be carried back to an electrophotographic photosensitive member.

Furthermore, examples of a material constituting the intermediate transfer belt include: resins such as urethane resin, fluororesin, polycarbonate resin, polyethylene terephthalate, polyamide resin and polyimide resin; and elastic materials such as silicone rubber, urethane rubber and hydrine rubber. Fluororesin, polyimide resin or polyethylene terephthalate is preferred from the view point of mechanical strength and electrophotographic characteristics. Adjustment of resistivity can be performed by dispersing conductive particles such as a carbon black or metal particles (e.g., titanium oxide particles or tin oxide particles) in the resin or the elastic material. Volume resistivity can be reduced by increasing an amount of the conductive particles.

Tension of the intermediate transfer belt is preferably set so that elongation is within 1%, thereby preventing rupture or permanent set of the intermediate transfer belt. Furthermore, thickness of the intermediate transfer belt is preferably 10 to 200 μm.

Next, a transfer medium convey member will be described.

Examples of the transfer medium convey member include an endless transfer medium conveyor belt which is fitted over and around a roller (including a driving roller and a tension roller). Volume resistivity of the transfer medium conveyor belt is preferably $10^7$ to $10^{13}$ Ω·cm and more preferably $10^8$ to $10^{12}$ Ω·cm. If the volume resistivity is too large, charge accumulated in the transferring process may adversely affect the removal of the toner which has contaminated the transfer medium conveyor belt. If the volume resistivity is too small, attachment of the transfer medium may be unstable.

Furthermore, examples of a material constituting the transfer medium conveyor belt include: resins such as urethane resin, fluororesin, polycarbonate resin, polyethylene terephthalate, polyamide resin and polyimide resin; and elastic materials such as silicone rubber, urethane rubber and hydrine rubber. Fluororesin (e.g., polyvinylidene fluoride, ethylene-tetrafluoroethylene copolymer), polycarbonate resin, polyethylene terephthalate or polyimide resin is preferred from the viewpoint of a transferring property and an attachment property of the transfer medium. Adjustment of resistivity can be performed by dispersing conductive particles such as a carbon black or metal particles (e.g., titanium oxide particles or tin oxide particles) in the resin or the elastic material. Volume resistivity can be reduced by increasing an amount of the conductive particles.

Tension of the transfer medium conveyor belt is preferably set so that elongation is within 1%, thereby preventing rupture or permanent set of the transfer medium conveyor belt. Furthermore, thickness of the transfer medium conveyor belt is preferably 10 to 200 μm.

In order to prevent charges accumulated on the transfer medium conveyor belt from adversely affecting a transferring property and an attachment property of the transfer medium, it is possible to remove the charges on the transfer medium conveyor belt by charge removing means before the subsequent color toner image is transferred. However, if the transfer medium conveyor belt which is contaminated by the toner is passed through a charge removing device, contamination of the charge removing device by the toner, charge up (or charge loss) of the toner, or in the worse case, discharge breakdown of the transfer medium conveyor belt may be caused.

Surface roughness Rz of the peripheral surface (on which the transfer medium is held) of the transfer medium conveyor belt is preferably 5 μm or less and more preferably 3 μm or less. If the surface roughness Rz exceeds 5 μm, adhesion between the toner contaminating the transfer medium conveyor belt and the surface of the transfer medium conveyor belt may be increased. As a result, the toner contaminating the transfer medium conveyor belt may be hardly removed.

On the other hand, surface roughness Rz of the surface of the transfer medium conveyor belt is preferably 0.05 μm or more. The reason is as follows. In order to control a charge amount per unit area of toner, inorganic particles each having a particle diameter of approximately 0.001 to 0.05 μm, such as silica particles, titanium oxide particles or zinc oxide particles are externally added to the toner. Since such submicronic particles have a strong electrostatic attachment force to the transfer medium conveyor belt, the particles are hardly removed from the surface of the transfer medium conveyor belt. Therefore, it is rather preferred that the surface roughness Rz of the conveyor belt be set to be larger than the particle size (diameter) of such an external additive, thereby appropriately embedding the additive in the conveyor belt.

In the present invention, the volume resistivity is obtained as follows. Measurement is performed using a measurement probe in accordance with JIS-K6911. Voltage of 100 V is applied to a sample to be measured by a high resistance meter R8340 (manufactured by ADVANTEST CORPORATION) to obtain a measured value. The measured value is normalized using thicknesses of the intermediate transfer belt and the transfer medium conveyor belt to obtain volume resistivity.

In order to set the surface roughness of the peripheral surface of the intermediate transfer belt or the transfer medium conveyor belt in the above-mentioned range, for example, the following methods are employed, including a method in which a belt is shaped in a mold by being heated while surface roughness of the surface of the mold which is in contact with the belt is set to be much smaller than the above-mentioned value, and another method in which the surface of the belt after being molded is smoothed by post-molded processing such as polishing.

Next, description will be made of toner.

An electrophotographic photosensitive member according to the present invention has significantly improved effect of transfer efficiency when using a toner having a smaller particle diameter, and especially significantly improved effect of transfer efficiency when using a non-magnetic toner containing no magnetic material.

As the toner, a non-magnetic one-component toner containing a binder resin, a colorant, a charge control agent and a low-softening material is preferably used.

The binder resin of the toner may be one which is ordinarily used, and examples thereof include: styrene type copolymers such as styrene/polyester, and styrene/butyl acrylate; polyester resin; and epoxy resin.

The colorant may be one which is ordinarily used, and, for example, for the yellow toner, benzine yellow pigment, phorone yellow, acetoacetanilide insoluble azo pigment, monoazo dye, azomethine pigment, and the like can be given.

For the magenta toner, xanthene magenta dye phosphotungstic molybdic acid lake pigment; 2,9-dimethylquinacridone; naphthol insoluble azo pigment; anthraquinone dye; colorants made from xanthene dye and organic carboxylic acid; thioindigo; and naphthol insoluble azo pigment can be given.

For the cyan toner, copper phthalocyanine pigment, and the like can be given.

The charge control agent may be one which is ordinarily used, and examples of the negative charge control agent include: alkylsalicylic acid metal complex; dicarboxylic acid metal complex; and polycyclic salicylic acid metal salt, and examples of the positive charge control agent include: quaternary ammonium salt; benzothiazole derivatives; guanamine derivatives; dibutyltin oxide; and other nitrogen-containing compounds.

Examples of the low-softening material include: polymethylene wax such as paraffin wax, polyolefin wax, microcrystalline wax, and Fischer-Tropsch wax; amide wax; higher fatty acids; long chain alcohols; ester wax; and derivatives thereof such as graft compounds, and block compounds, and the content of the low-softening material is preferably 5 to 30 weight % based on the total weight of the toner.

A number-average circle-equivalent diameter D1 of the toner is preferably 2 to 10 μm. Furthermore, an average circularity of the toner is preferably 0.920 to 0.995, more preferably 0.950 to 0.995 and most preferably 0.970 to 0.990. Standard deviation of the circularity of the toner is preferably less than 0.040 and more preferably less than 0.035. On the other hand, the standard deviation of the circularity of the toner is preferably 0.015 or more.

In the present invention, a number-average circle-equivalent diameter (D1), a circularity, an average circularity and standard deviation of the circularity respectively mean a number-average equivalent diameter (D1), a circularity, an average circularity and standard deviation of the circularity in a number-based circle-equivalent diameter-circularity scattergram obtained from a flow type particle image measuring apparatus.

Furthermore, in the present invention, preferred is a toner in which a wax component is dispersed in a binder resin in a spherical or spindle island state so as to satisfy the following expression:

$$0.05 \leqq (r/R)st \leqq 0.95,$$

and the toner satisfying the following expression is especially preferred:

$$0.25 \leqq (r/R)st \leqq 0.90.$$

Here, (r/R)st is determined as follows. Initially, a cross section of the toner is observed using a transmission electron microscope (TEM). Then, 20 of cross sections of the toner, whose longest diameters R respectively satisfy the following expression, are selected:

$$0.9 \leqq R/D4 \leqq 1.1$$

in the expression, D4 is a weight-average circle-equivalent diameter D4 (on weight basis) obtained from a flow type particle image measuring apparatus. Then, the longest diameter r of the largest wax component phase separation structure among those existing in each of the 20 selected cross sections of the toner is measured. Finally, an arithmetical mean (r/R)st is calculated from r/R.

Furthermore, by using a non-magnetic toner containing no magnetic substance, more satisfactory effect of the present invention can be obtained.

EXAMPLES

The present invention will be described below in detail by giving specific examples. However, the present invention is not limited to those examples. In examples, "part(s)" means "part(s) by weight" without specific indication.

Initially, diorganopolysiloxane employed in the present invention can be synthesized as follows.

Synthesis Example 1

3.23 g of polysiloxane having the below-indicated repeating structure units α, β and γ, 20 ppm of chloroplatinic acid (5% isopropanol solution), 18.9 g of polystyrene having a chemical structure represented by the below-indicated formula (n: 25 on average), and 80 g of m-xylene hexafluoride were mixed in a flask and the whole was gradually heated.

| Repeating structure unit | Chemical Structure | Average (number) |
|---|---|---|
| α | 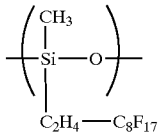 | 30 |
| β | 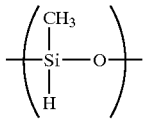 | 30 (n: Average 25) |
| γ | 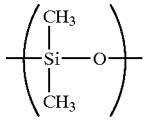 | 31 |

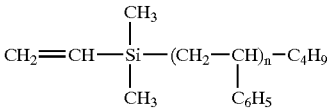

Furthermore, the reaction was carried out at 80° C. for 6 hours. Then, pressure in the flask was reduced to 20 Torr (2666.45 Pa) at 140° C. to remove a solvent and a low boiling-point component.

The thus-obtained reaction product was subjected to analyses by $^{29}$Si-NMR, $^{13}$C-NMR and FT-IR. As a result, the product was identified as diorganopolysiloxane (1-1).

Synthesis Example 2

Synthesis was conducted in the same manner as in Synthesis Example 1 except that the polystyrene was charged for 13.4 g of polystyrene having a chemical structure represented by the below-indicated formula (n: 25 on average):

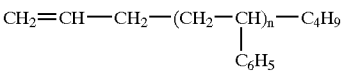

The thus-obtained reaction product was subjected to analyses by $^{29}$Si-NMR, $^{13}$C-NMR and FT-IR. As a result, the product was identified as diorganopolysiloxane (1-4).

Diorganopolysiloxanes employed in the present invention and having a different chemical structure can be synthesized in the same manner as Synthesis Examples 1 and 2.

Example 1-1

An aluminum cylinder having a diameter of 30 mm and a length of 357 mm was used as a support. An application fluid for forming a conductive layer containing the below-indicated components was applied onto the support by a dip coating method. Then, the applied fluid on the support was thermally cured at 140° C. for 30 minutes to form a conductive layer having a thickness of 15 μm.

| | |
|---|---|
| Conductive pigment: | |
| Barium sulfate coated with $SnO_2$ | 10 parts |
| Resistance adjustment pigment: | |
| Titanium oxide | 2 parts |
| Binder resin: | |
| Phenol resin | 6 parts |
| Leveling agent: | |
| Silicone oil | 0.001 part |
| Solvent: | |
| Methanol/methoxypropanol (2/8) | 20 Parts |

Then, a solution containing 3 parts of N-methoxymetylated nylon and 3 parts of copolymerized nylon in a mixed solvent of methanol (65 parts)/n-butanol (30 parts) was applied onto the conductive layer by a dip coating method to form an intermediate layer having a thickness of 0.5 μm.

Then, a liquid containing 9 parts of hydroxy gallium phthalocyanine crystal of crystalline form having strong peaks at 7.3° and 28.1° of Bragg angle (2θ±0.2°) in CuKα characteristic X-ray diffraction and 3 parts of polyvinyl butyral (Trade name, S-LEC BX-1; produced by Sekisui Chemical Co., Ltd.) in 100 parts of tetrahydrofuran was dispersed for 3 hours in a sand mill apparatus using glass beads each having a diameter of 1 mm.

To dilute the dispersant, 200 parts of butyl acetate was added. Then, the thus-obtained dispersion was applied onto the intermediate layer by a dip coating method and was dried at 100° C. for 10 minutes to form a charge generation layer having a thickness of 0.30 μm.

Then, an application fluid for forming a charge transport layer composed of components as described below was applied onto the charge generation layer and was dried at 130° C. for 1 hour to form a charge transport layer having a thickness of 30 μm.

Binder resin:

Polyarylate resin having a repeating structure unit represented by Formula (7-2) (weight-average molecular weight: 128,000) 10 parts Charge transport material:

Amine compound A having a structure represented by the following formula 7 parts

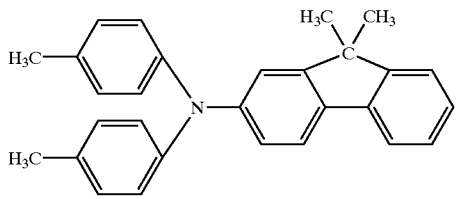

Charge transport material:

Amine compound B having a structure represented by the following formula 1 part

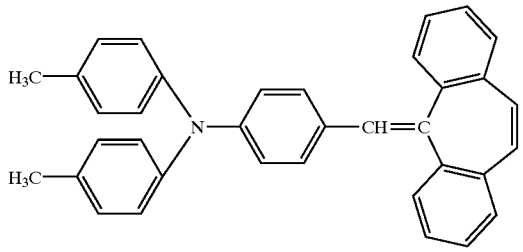

Diorganopolysiloxane:

Diorganopolysiloxane (1-4) (weight-average molecular weight: 36,000) 0.18 parts

Solvent:

Monochlorobenzene/dimethoxymethane (6/4) 20 parts

Thus, an electrophotographic photosensitive member in which a charge transport layer was a surface layer was manufactured.

Next, evaluation will be described.

As an evaluation apparatus, a color laser printer LBP-2040 (manufactured by Canon Inc.; 16 sheets/minute for monochrome printing and 4 sheets/minute for color printing) which was a color electrophotographic apparatus as shown in FIG. 2 and employing the intermediate transfer system was remodeled and used. The remodeling was made so that the apparatus could be operated without an intermediate transfer belt unit. Furthermore, a transfer bias was set to be 60% of that before remodeling. In addition, the remodeling was made so that any developing devices could be selected and fixed to the apparatus. A toner having a number-average circle-equivalent diameter of 8 $\mu$m and an average circularity of 0.94 was used.

The evaluation was performed as follows. Initially, an intermediate transfer belt unit was detached from the apparatus, a halftone image (black monochrome) having a printing percentage of 50% for a sheet of A4-size original paper was formed, and cleaning was performed directly. Then, the weight of waste toner was measured to be denoted as W1. Next, the intermediate transfer belt unit was attached on the apparatus, and a halftone image having a printing percentage of 50% for a sheet of A4-size original paper was formed and transferred. The apparatus was stopped when the transfer was completed. Then, weight of the waste toner was measured to be denoted as W2. Transfer efficiency T was determined by the following calculation: $[(W1-W2)/W1]\times 100$.

Furthermore, a monochrome 20,000-sheet intermittent running test was carried out using the above-mentioned apparatus and A4-size plain paper. A transfer bias during running test was set to be the same value as that before the remodeling. The toner was replenished if it was exhausted. Weights of the waste toner after the running test $W1_{20000}$ and $W2_{20000}$ were respectively measured and transfer efficiency $T_{20000}$ was determined in the manner as described above.

Furthermore, an electrophotographic photosensitive member which was the same as the above-mentioned electrophotographic photosensitive member was manufactured. Image evaluation was performed by printing a black monochrome halftone image and a full-color picture image using the manufactured photosensitive member and the above-mentioned evaluation apparatus. The halftone image was evaluated for dot reproducibility. The picture image was evaluated for overall print quality. The results of the evaluation of the halftone image and the picture image were represented by criteria 1 to 3. The larger numeral indicates the superior quality.

The results of the above-mentioned evaluation are shown in Table 1.

Example 1-2

An electrophotographic photosensitive member was manufactured and evaluation was performed in the same manner as in Example 1-1 except that the content of diorganopolysiloxane in an application fluid for forming a charge transport layer was changed from 0.18 parts to 0.9 parts. The results of the evaluation are shown in Table 1.

Example 1-3

An electrophotographic photosensitive member was manufactured and evaluation was performed in the same manner as in Example 1-2 except that diorganopolysiloxane (1-17) (weight-average molecular weight: 38,000) was used in an application fluid for forming a charge transport layer in place of diorganopolysiloxane (1-4). The results of the evaluation are shown in Table 1.

Example 1-4

An electrophotographic photosensitive member was manufactured and evaluation was performed in the same manner as in Example 1-2 except that diorganopolysiloxane (1-22) (weight-average molecular weight: 35,000) was used in an application fluid for forming a charge transport layer in place of diorganopolysiloxane (1-4). The results of the evaluation are shown in Table 1.

Example 1-5

An electrophotographic photosensitive member was manufactured and evaluation was performed in the same manner as in Example 1-2 except that diorganopolysiloxane (1-5) (weight-average molecular weight: 29,000) was used in an application fluid for forming a charge transport layer in place of diorganopolysiloxane (1-4). The results of the evaluation are shown in Table 1.

Example 1-6

An electrophotographic photosensitive member was manufactured and evaluation was performed in the same manner as in Example 1-1 except that polycarbonate resin having a repeating structure unit represented by Formula (6-3) (weight-average molecular weight: 106,000) was used in an application fluid for forming a charge transport layer in place of polyarylate resin having a repeating structure unit represented by Formula (7-2) (weight-average molecular weight: 128,000). The results of the evaluation are shown in Table 1.

Example 1-7

An electrophotographic photosensitive member was manufactured and evaluation was performed in the same manner as in Example 1-6 except that the content of diorganopolysiloxane in an application fluid for forming a charge transport layer was changed from 0.18 parts to 0.9 parts. The results of the evaluation are shown in Table 1.

Examples 1-8 to 1-14

Electrophotographic photosensitive members were manufactured and evaluation was performed in the same manner as in Examples 1-1 to 1-7, respectively, except that: in the running test and the halftone image evaluation, a cyan developing device was fixed to print a cyan monochrome image. The results of the evaluation are shown in Table 1.

Comparative Example 1-1

An electrophotographic photosensitive member was manufactured and evaluation was performed in the same manner as in Example 1-1 except that no diorganopolysiloxane-was added to the application fluid for forming a charge transport layer. The results of the evaluation are shown in Table 1.

Comparative Example 1-2

An electrophotographic photosensitive member was manufactured and evaluation was performed in the same manner as in Example 1-1 except that silicone oil (product name, KF96; produced by Shin-Etsu Silicones Inc.,) was used in the application fluid for forming a charge transport layer in place of diorganopolysiloxane. The results of the evaluation are shown in Table 1.

Comparative Example 1-3

An electrophotographic photosensitive member was manufactured and evaluation was performed in the same manner as in Example 1-1 except that a silicone compound (product name, GS101; produced by Toagosei Co., Ltd.) was used in the application fluid for forming a charge transport layer in place of diorganopolysiloxane. The results of the evaluation are shown in Table 1.

Comparative Example 1-4

An electrophotographic photosensitive member was manufactured and evaluation was performed in the same manner as in Comparative Example 1-1 except that a mixture of polyarylate resin having a repeating structure unit represented by the above Formula (7-3) (weight-average molecular weight: 113,000) and a copolymer having a repeating structure unit represented by the above Formula (7-3) and a repeating structure unit represented by the below-indicated formula (copolymerization ratio: 1:9, weight-average molecular weight: 98,000), (whose mixing ratio was 9:1), was used in the application fluid for forming a charge transport layer in place of polyarylate resin having a repeating structure unit represented by the above Formula (7-2). The results of the evaluation are shown in Table 1.

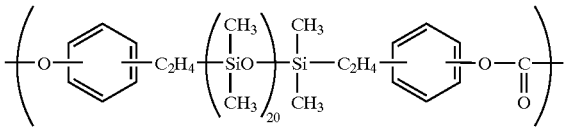

Comparative Example 1-5

An electrophotographic photosensitive member was manufactured and evaluation was performed in the same manner as in Example 1-1 except that a charge transport layer was formed in the below-indicated manner. The results of the evaluation are shown in Table 1.

10 parts of polyarylate resin having a repeating structure unit represented by Formula (7-2) (weight-average molecular weight: 128,000) was dissolved in 100 parts of chlorobenzene. 10 parts of tetrafluoroethylene resin particles (trade name, LUBRON L-2; produced by Daikin Industries Ltd.; average particle size (primary particle), 0.3 $\mu$m; average particle size (secondary particle), 5 $\mu$m) as fluorineatomntaining resin particles and 2 parts of diorganopolysiloxane (1-4) (weight-average molecular weight: 36,000) were added thereto and the whole was sufficiently shaken. The mixture was twice subjected to a dispersing treatment using a fluid-impact type disperser, thereby preparing a fluorine atom-containing resin particle dispersant.

Then, polyarylate resin having a repeating structure unit represented by Formula (7-2), the above-mentioned amine compound A, and the above-mentioned amine compound B were added to the fluorine atom-containing resin particle dispersion to adjust the composition thereof so that the final ratio by weight of: the polyarylate resin having a repeating structure unit represented by Formula (7-2): the amine compound A: the amine compound B: the above-mentioned tetrafluoroethylene resin particles: the diorganopolysiloxane (1-4): and the solvent (chlorobenzene) was 10:9:1:1:0.2:80.

The thus-obtained dispersion was applied onto a charge generation layer by a dip coating method and was dried at 130° C. for 1 hour to form a charge transport layer having a thickness of 30 $\mu$m.

TABLE 1

| | Initial transfer efficiency T(%) | Transfer efficiency after 20,000-sheet running test $T_{20000}$ (%) | Halftone image | Picture image |
|---|---|---|---|---|
| Example 1-1 | 93 | 89 | 3 | 3 |
| Example 1-2 | 95 | 90 | 3 | 3 |
| Example 1-3 | 92 | 90 | 3 | 3 |
| Example 1-4 | 95 | 91 | 3 | 3 |
| Example 1-5 | 94 | 90 | 3 | 3 |
| Example 1-6 | 96 | 90 | 3 | 3 |
| Example 1-7 | 97 | 93 | 3 | 3 |
| Example 1-8 | 91 | 90 | 3 | 3 |
| Example 1-9 | 93 | 89 | 3 | 3 |
| Example 1-10 | 93 | 91 | 3 | 3 |
| Example 1-11 | 95 | 90 | 3 | 3 |
| Example 1-12 | 94 | 93 | 3 | 3 |
| Example 1-13 | 95 | 92 | 3 | 3 |
| Example 1-14 | 95 | 91 | 3 | 3 |
| Comparative Example 1-1 | 67 | 52 | 3 | 3 |
| Comparative Example 1-2 | 75 | 50 | 3 | 3 |
| Comparative Example 1-3 | 73 | 57 | 3 | 3 |

TABLE 1-continued

| | Initial transfer efficiency T(%) | Transfer efficiency after 20,000-sheet running test $T_{20000}$ (%) | Halftone image | Picture image |
|---|---|---|---|---|
| Comparative Example 1-4 | 69 | 55 | 3 | 3 |
| Comparative Example 1-5 | 89 | 85 | 2 | 1 |

Example 2-1

An electrophotographic photosensitive member was manufactured in the same manner as in Example 1-1.

Next, evaluation will be described.

As an evaluation apparatus, a copying machine CLC1000 (manufactured by Canon Inc.; 31 sheets/minute printing) which was a color electrophotographic apparatus having a constitution as shown in FIG. 3 and employing the inline system was remodeled and used. The remodeling was made so that the main door was opened, and the transfer medium conveyor belt was detached from the ordinary position of the apparatus. Also, a circuit was modified so that even if copy paper was not set in the machine, all other operations could be performed. Furthermore, the transfer bias was set to be 60% of that before remodeling. Toner having a number-average circle-equivalent diameter of 8 μm and an average circularity of 0.94 was used for developing means.

The evaluation was performed as follows. Initially, the main door was opened and the transfer medium conveyor belt was detached from the ordinary position of the apparatus. Furthermore, in a black image forming portion in the absence of copy paper, a halftone image (black monochrome) having a printing percentage of 50% for a sheet of A4-size original paper was formed in the absence of transfer medium (such as paper), and cleaning was performed directly. Then, the weight of waste toner was measured to be denoted as W1. Next, the transfer medium conveyor belt was returned to the ordinary position of the apparatus, and a halftone image having a printing percentage of 50% for a sheet of A4-size original paper was formed and transferred to an OHP sheet as a transfer medium. The apparatus was stopped when the transfer was completed. And then, the OHT sheet before fixing was taken out of the apparatus. All the toner on the OHT sheet was collected and weight thereof was measured to be denoted as W2. Transfer efficiency T was determined by the following calculation: $(W2/W1)/W1)\times 100$.

Furthermore, a color 20,000-sheet intermittent running test was carried out using the apparatus and A4-size plain paper. A transfer bias was set to be the value before the remodeling. The toner was replenished if it was exhausted. After the running test, the weight of the waste toner after the running test $W1_{20000}$ and $W2_{20000}$ were respectively measured and transfer efficiency $T_{20000}$ was determined as described above.

Furthermore, image evaluation was performed by printing a black monochrome halftone image and a full-color picture image using a photosensitive member and an evaluation apparatus equivalent to the above. The halftone image was evaluated for dot reproducibility. The picture image was evaluated for overall print quality.

The results of the above-mentioned evaluation are shown in Table 2.

Examples 2-2 to 2-7

Electrophotographic photosensitive members were manufactured in the same manner as in Examples 1-2 to 1-7, and evaluation was performed in the same manner as in Example 2-1, respectively. The results of the evaluation are shown in Table 2.

Examples 2-8 to 2-14

Electrophotographic photosensitive members were manufactured and evaluation was performed in the same manner as in Examples 2-1 to 2-7, respectively, except that: a toner having a number-average circle-equivalent diameter of 6.5 μm and an average circularity of 0.98 and in which a wax component was dispersed in a sperical state in toner particles was used. The results of the evaluation are shown in Table 2.

Comparative Examples 2-1 to 2-5

Electrophotographic photosensitive members were manufactured in the same manner as in Comparative Examples 1-1 to 1-5, and evaluation was performed in the same manner as in Example 2-1, respectively. The results of the evaluation are shown in Table 2.

TABLE 2

| | Initial transfer efficiency T(%) | Transfer efficiency after 20,000-sheet running test $T_{20000}$ (%) | Halftone image | Picture image |
|---|---|---|---|---|
| Example 2-1 | 83 | 81 | 3 | 3 |
| Example 2-2 | 91 | 86 | 3 | 3 |
| Example 2-3 | 88 | 85 | 3 | 3 |
| Example 2-4 | 86 | 82 | 3 | 3 |
| Example 2-5 | 89 | 87 | 3 | 3 |
| Example 2-6 | 90 | 84 | 3 | 3 |
| Example 2-7 | 91 | 88 | 3 | 3 |
| Example 2-8 | 85 | 80 | 3 | 3 |
| Example 2-9 | 93 | 90 | 3 | 3 |
| Example 2-10 | 91 | 83 | 3 | 3 |
| Example 2-11 | 89 | 85 | 3 | 3 |
| Example 2-12 | 90 | 86 | 3 | 3 |
| Example 2-13 | 90 | 88 | 3 | 3 |
| Example 2-14 | 94 | 90 | 3 | 3 |
| Comparative Example 2-1 | 62 | 48 | 3 | 3 |
| Comparative Example 2-2 | 71 | 52 | 3 | 3 |
| Comparative Example 2-3 | 69 | 56 | 3 | 3 |
| Comparative Example 2-4 | 66 | 50 | 3 | 3 |
| Comparative Example 2-5 | 82 | 76 | 2 | 1 |

According to the present invention, it is possible to provide an electrophotographic photosensitive member capable of maintaining high transfer efficiency without causing large transfer current for a long-term use, providing an excellent image, and to provide an electrophotographic photosensitive member capable of maintaining high transfer efficiency without causing large transfer current for a long-term use, and providing an excellent image especially when being applied to the above-mentioned color electrophotographic apparatus. Furthermore, a process cartridge and an electrophotographic apparatus each having such an electrophotographic photosensitive member can be provided.

What is claimed is:

1. An electrophotographic photosensitive member comprising a photosensitive layer on a support;

and wherein a surface layer of the electrophotographic photosensitive member contains diorganopolysiloxane having a repeating structure unit α represented by Formula (11) and a repeating structure unit β represented by Formula (12), and having a weight-average molecular weight of 1,000 to 1,000,000, and wherein the content of the diorganopolysiloxane in the surface layer is 0.01 to 20% by weight based on an entire weight of the surface layer, and wherein the surface layer does not contain fluorine atom-containing resin particles:

(11)

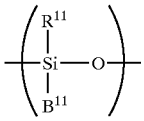

(12)

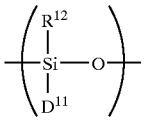

in Formula (11) and (12), $R^{11}$ and $R^{12}$ are independently a substituted or unsubstituted monovalent hydrocarbon group, $B^{11}$ is a monovalent organic group having a perfluoroalkyl group, and $D^{11}$ is a monovalent group selected from the group consisting of: a monovalent organic group having a substituted or unsubstituted polystyrene chain with a polymerization degree of 3 or more; a monovalent organic group having a substituted or unsubstituted alkyleneoxy group; a monovalent organic group having a substituted or unsubstituted siloxane chain and; a monovalent organic group having carbon atoms of 12 or more.

2. An electrophotographic photosensitive member according to claim 1, wherein the diorganopolysiloxane further has a repeating structure unit γ represented by Formula (13):

(13)

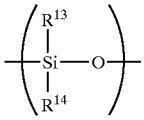

in Formula (13), $R^{13}$ and $R^{14}$ are independently a substituted or unsubstituted monovalent hydrocarbon group.

3. An electrophotographic photosensitive member according to claim 1, wherein the weight-average molecular weight of the diorganopolysiloxane is 10,000 to 200,000.

4. An electrophotographic photosensitive member according to claim 1, wherein the $R^{11}$ to $R^{16}$ are independently a substituted or unsubstituted alkyl group or a substituted or unsubstituted phenyl group.

5. An electrophotographic photosensitive member according to claim 1, wherein the monovalent organic group having a perfluoroalkyl group represented by $B^{11}$ is a monovalent group having a structure represented by Formula (2):

(2)

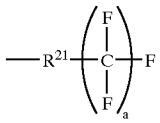

in Formula (2), $R^{21}$ is an alkylene group, or an alkyleneoxy-alkylene group, and a is an integer of 3 or more.

6. An electrophotographic photosensitive member according to claim 1, wherein the monovalent organic group having a substituted or unsubstituted polystyrene chain with a polymerization degree of 3 or more represented by $D^{11}$ is a monovalent group having a structure represented by Formula (3):

(3)

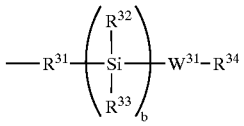

in Formula (3), $R^{31}$ is a substituted or unsubstituted divalent hydrocarbon group, $R^{32}$ and $R^{33}$ are independently a substituted or unsubstituted alkyl group or a substituted or unsubstituted aryl group, $W^{31}$ is a substituted or unsubstituted polystyrene chain with a polymerization degree of 3 or more, $R^{34}$ is a substituted or unsubstituted alkyl group or a substituted or unsubstituted aryl group, and b is 0 or 1.

7. An electrophotographic photosensitive member according to claim 1, wherein the monovalent organic group having a substituted or unsubstituted alkyleneoxy group represented by $D^{11}$ is a monovalent group having a structure represented by Formula (4):

(4)

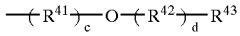

in Formula (4), $R^{41}$ and $R^{42}$ are independently a substituted or unsubstituted divalent hydrocarbon group, $R^{43}$ is a hydrogen atom or a substituted or unsubstituted monovalent hydrocarbon group, c is 0 or 1, and d is an integer of 1 or more and 300 or less.

8. An electrophotographic photosensitive member according to claim 1, wherein the monovalent organic group having a substituted or unsubstituted siloxane chain represented by $D^{11}$ is a monovalent group having a structure represented by Formula (5):

(5)

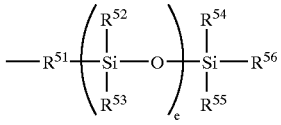

in Formula (5), $R^{51}$ is an alkylene group, an alkyleneoxy group or an oxygen atom, $R^{52}$ to $R^{56}$ are independently a substituted or unsubstituted alkyl group or a substituted or unsubstituted aryl group, and e is an integer of 3 or more.

9. An electrophotographic photosensitive member according to claim 1, wherein the content of the diorganopolysiloxane having a structure represented by Formula (1) in the surface layer is 0.1 to 10% by weight based on the entire weight of the surface layer.

10. An electrophotographic photosensitive member according to claim 1, wherein the surface layer contains a binder resin.

11. An electrophotographic photosensitive member according to claim 10, wherein the binder resin is polyarylate resin or polycarbonate resin.

12. A process cartridge detachably mountable to a main body of an electrophotographic apparatus, comprising and integrally supporting an electrophotographic photosensitive member and at least one selected from the group consisting of: charging means for charging a surface of the electrophotographic photosensitive member; developing means for developing an electrostatic latent image formed on the surface of the electrophotographic photosensitive member by use of toner, so as to form a toner image; transfer means for transferring the toner image formed on the surface of the electrophotographic photosensitive member by the developing means to a transfer medium or an intermediate transfer member; and cleaning means for cleaning the toner remaining on the surface of the electrophotographic photosensitive member after the transferring process by the transfer means, wherein the electrophotographic photosensitive member is one according to any of claims 1 to 11.

13. An electrophotographic apparatus, comprising:

an electrophotographic photosensitive member;

charging means for charging a surface of the electrophotographic photosensitive member;

exposure means for exposing the surface of the electrophotographic photosensitive member thus charged by the charging means to exposure light, so as to form an electrostatic latent image;

developing means for developing the electrostatic latent image, which is formed on the surface of the electrophotographic photosensitive member by the exposure means, by use of toner so as to form a toner image; and transfer means for transferring the toner image formed on the surface of the electrophotographic photosensitive member by the developing means to one of a transfer medium and an intermediate-transfer member, wherein the electrophotographic photosensitive member is one according to any of claims 1 to 11.

14. An electrophotographic apparatus, comprising:

an electrophotographic photosensitive member;

charging means for charging a surface of the electrophotographic photosensitive member;

exposure means for exposing the surface of the electrophotographic photosensitive member charged by the charging means to exposure light, so as to form an electrostatic latent image;

developing means for developing the electrostatic latent image, which is formed on the surface of the electrophotographic photosensitive member by the exposure means, by use of toner so as to form a toner image;

transfer medium holding member for holding a transfer medium; and transfer means for transferring the toner image formed on the surface of the electrophotographic photosensitive member by the means to the transfer medium held on the transfer medium holding member, wherein the electrophotographic photosensitive member is one according to claim 1.

15. An electrophotographic apparatus, comprising:

an electrophotographic photosensitive member;

charging means for charging a surface of the electrophotographic photosensitive member;

exposure means for exposing the surface of the electrophotographic photosensitive member charged by the charging means to exposure light, so as to form an electrostatic latent image;

developing means for developing the electrostatic latent image, which is formed on the surface of the electrophotographic photosensitive member by the exposure means, by use of toner so as to form a toner image;

an intermediate transfer member for holding the toner image to be secondarily transferred to a transfer medium, the toner image having been formed on the surface of the electrophotographic photosensitive member by the developing means and primarily transferred from the surface of the electrophotographic photosensitive member;

primary transfer means for transferring the toner image formed on the surface of the electrophotographic photosensitive member by the developing means to the surface of the intermediate transfer member; and secondary transfer means for secondarily transferring the toner image transferred by the primary transfer means and held on the surface of the intermediate transfer member to the transfer medium, wherein the electrophotographic photosensitive member is one according to claim 1.

16. An electrophotographic apparatus comprising a transfer medium convey member for holding a transfer medium and carrying the transfer medium to a transfer position, and a plurality of image forming portions; each of the image forming portions comprising at least:

an electrophotographic photosensitive member;

charging means for charging a surface of the electrophotographic photosensitive member;

exposure means for exposing the surface of the electrophotographic photosensitive member charged by the charging means to exposure light, so as to form an electrostatic latent image;

developing means for developing the electrostatic latent image, which is formed on the surface of the electrophotographic photosensitive member by the exposure means, by use of toner so as to form a toner image; and transfer means for transferring the toner image formed on the surface of the electrophotographic photosensitive member by the developing means to the transfer medium conveyed by the transfer medium convey member, wherein the electrophotographic photosensitive member is one according to claim 1.

* * * * *

UNITED STATES PATENT AND TRADEMARK OFFICE

CERTIFICATE OF CORRECTION

PATENT NO. : 6,942,952 B2 
DATED : September 13, 2005
INVENTOR(S) : Hirotoshi Uesugi et al.

It is certified that error appears in the above-identified patent and that said Letters Patent is hereby corrected as shown below:

Title page, Item [54] and Column 1, lines 1-4,
Title, "ELECTROPHOTGRAPHIC PHOTOSENSITIVE MEMBER, PROCESS CARTRIDGE, AND ELECTROPHOTGRAPHIC APPARATUS" should read -- ELECTROPHOTOGRAPHIC PHOTOSENSITIVE MEMBER, PROCESS CARTRIDGE, AND ELECTROPHOTOGRAPHIC APPARATUS --.

Title page,
Item [56], References Cited, FOREIGN PATENT DOCUMENTS,

| | | |
|---|---|---|
| "00-81715 | should read -- | 2000-81715 |
| 2001/249481 | | 2001-249481 |
| 2001/249552 | | 2001-249552 |
| 2002/162767" | | 2002-162767 --. |

Column 6,
Line 35, "in" should read -- wherein in --.

Column 7,
Lines 23 and 42, "in" should read -- wherein in --.

Column 8,
Line 23, "in" should read -- wherein in --.

Column 46,
Line 34, "N-methoxymetylated" should read -- N-methoxymethylated --.

Column 49,
Line 15, "that:" should read -- that --;
Line 25, "diorganopolysiloxane-was" should read -- diorganopolysiloxane was --; and
Line 35, "Inc.,)" should read -- Inc.) --.

Column 50,
Line 22, "fluorineatom-" should read -- fluorine atom- --;
Line 23, "ntaining" should read -- containing --;
Line 35, "Formula (7-2):" should read -- Formula (7-2); --;
Line 36, "compound A:" should read -- compound A; -- and "compound B:" should read -- compound B; --;
Line 37, "particles:" should read -- particles; --; and
Line 38, "(1-4):" should read (1-4); --.

UNITED STATES PATENT AND TRADEMARK OFFICE

CERTIFICATE OF CORRECTION

PATENT NO. : 6,942,952 B2
DATED : September 13, 2005
INVENTOR(S) : Hirotoshi Uesugi et al.

It is certified that error appears in the above-identified patent and that said Letters Patent is hereby corrected as shown below:

Column 52,
Line 11, "that:" should read -- that; --.

Column 53,
Line 1, "and" should be deleted;
Line 36, "chain and:" should read -- chain; and --;
Line 51, "in" should read -- wherein in --; and
Line 59, "to R16" should read -- and $R^{12}$ --.

Column 54,
Lines 8, 24, 41 and 59, "in" should read -- wherein in --; and
Line 65, "Formula (1)" should read -- Formula (12) --.

Column 56,
Line 1, "the means" should read -- the developing means --.

Signed and Sealed this

Sixteenth Day of May, 2006

JON W. DUDAS
*Director of the United States Patent and Trademark Office*